US007322921B2

(12) United States Patent
Allen et al.

(10) Patent No.: US 7,322,921 B2
(45) Date of Patent: Jan. 29, 2008

(54) METHOD OF FORMING A BAG

(75) Inventors: John R. Allen, Tifton, GA (US); Stuart R. Sharp, Greer, SC (US)

(73) Assignee: Exopack Technology, LLC, Spartanburg, SC (US)

( * ) Notice: Subject to any disclaimer, the term of this patent is extended or adjusted under 35 U.S.C. 154(b) by 50 days.

(21) Appl. No.: 11/201,871

(22) Filed: Aug. 11, 2005

(65) Prior Publication Data

US 2005/0272585 A1 Dec. 8, 2005

Related U.S. Application Data

(60) Division of application No. 10/366,490, filed on Feb. 13, 2003, now Pat. No. 6,994,471, which is a continuation-in-part of application No. 10/341,987, filed on Jan. 14, 2003, now abandoned.

(51) Int. Cl.
*B31B 1/90* (2006.01)

(52) U.S. Cl. ..... 493/214; 493/276; 493/331; 493/333

(58) Field of Classification Search ..... 493/214, 493/276, 331, 333
See application file for complete search history.

(56) References Cited

U.S. PATENT DOCUMENTS 3,595,468 A * 7/1971 Repko ..... 206/84
4,464,158 A * 8/1984 Kardon ..... 493/265
4,471,875 A 9/1984 Hain et al.
4,709,397 A * 11/1987 Voshall et al. ..... 383/5
4,834,552 A 5/1989 Makowka
4,946,289 A 8/1990 Bolling et al.
4,952,441 A 8/1990 Bose et al.
4,988,547 A 1/1991 Voto et al.
4,994,324 A 2/1991 Bose et al.
5,038,009 A 8/1991 Babbitt
5,051,284 A 9/1991 Johansson et al.
5,171,594 A 12/1992 Babbitt
5,294,470 A * 3/1994 Ewan ..... 428/41.6
5,345,399 A 9/1994 Collins
5,482,376 A 1/1996 Moseley et al.
5,488,220 A 1/1996 Freeks et al.
5,529,396 A 6/1996 Pryor et al.
5,558,438 A 9/1996 Warr
5,593,229 A 1/1997 Warr
5,601,369 A 2/1997 Mosely et al.

(Continued)

*Primary Examiner*—Hemant M. Desai
(74) *Attorney, Agent, or Firm*—Stoel Rives LLP; Samuel E. Webb

(57) ABSTRACT

A bag having a tamper evident closure and methods of forming the same are provided. The bag has a tube body with a front wall and a back wall positioned between a first end and a second end. A back flap extension member connects to and extends outwardly from the second end of the back wall. A primer material is positioned on the back flap extension member and an adhesive material is placed on the back flap extension member that folds over to overlie and contact the primer material. The back flap extension member adheres to the front flap extension member and portions of the front wall to close the second end. When the back flap extension member liftingly separates from the front wall, at least one of the back flap extension member and the front wall tears indicating evidence of tampering.

16 Claims, 17 Drawing Sheets

U.S. PATENT DOCUMENTS 5,611,626 A 3/1997 Warr
5,728,037 A 3/1998 Pryor et al.
5,770,839 A 6/1998 Ruebush et al.
5,798,169 A 8/1998 Smith
5,871,790 A 2/1999 Monier et al.
6,019,713 A 2/2000 Scypinski et al.
6,033,762 A * 3/2000 Decker ..... 428/201
6,046,443 A 4/2000 Ackerman et al.
6,065,871 A 5/2000 Warr
6,213,644 B1 4/2001 Henderson et al.
6,231,232 B1 5/2001 Warr
6,267,505 B1 7/2001 Henson
6,299,351 B1 10/2001 Warr
6,306,472 B1 10/2001 Buelow
6,374,461 B1 4/2002 Gober et al.
6,402,379 B1 6/2002 Albright
6,589,622 B1 * 7/2003 Scott ..... 428/40.1
6,609,999 B2 8/2003 Albright
6,632,403 B1 10/2003 Barmore et al.
6,893,686 B2 5/2005 Egan
2003/0118252 A1 * 6/2003 Geyer ..... 383/5
2004/0038792 A1 2/2004 Albright
2004/0091648 A1 5/2004 Hartzell et al.
2004/0136616 A1 7/2004 Allen et al.
2004/0137206 A1 7/2004 Pettis
2004/0175060 A1 9/2004 Woodham et al.
2004/0228547 A1 11/2004 Hartzell et al.
2005/0008736 A1 1/2005 Egan et al.

* cited by examiner

FIG. 18.
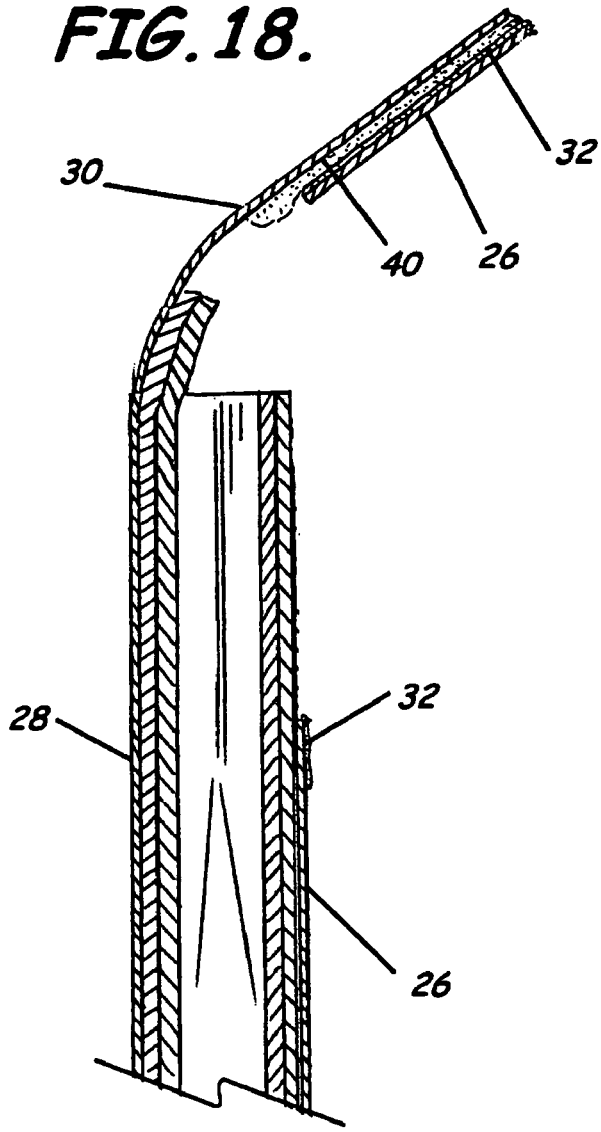
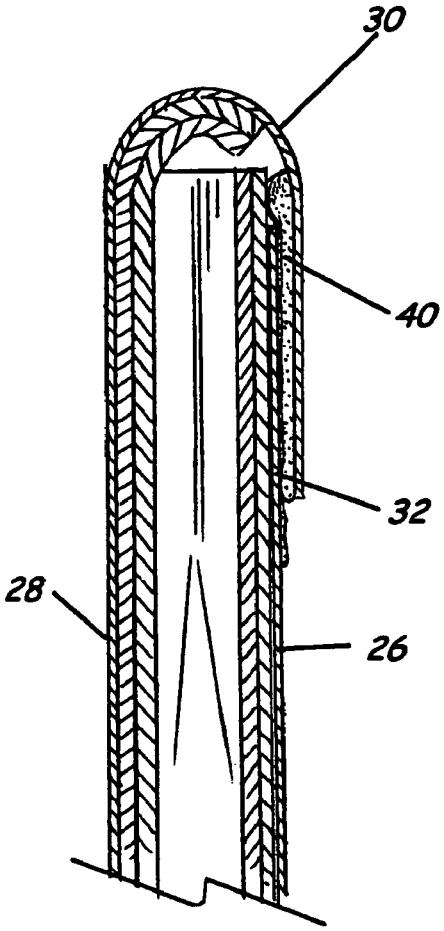
FIG. 17.

METHOD OF FORMING A BAG

RELATED APPLICATIONS

This application is a divisional application of U.S. application Ser. No. 10/366,490, filed on Feb. 13, 2003, now U.S. Pat. No. 6,994,471, issued on Feb. 07, 2006, which is a continuation-in-part of U.S. application Ser. No. 10/341,987, filed on Jan. 14, 2003, now abandoned, which hereby is incorporated by reference in its entirety.

BACKGROUND OF THE INVENTION

1. Field of the Invention

The invention relates generally to the packaging industry. In more specific aspects, the invention relates to packaging and methods for forming packaging that have tamper evident closures to indicate that tampering with the packaging may have occurred.

2. Description of the Related Art

Many types of end user or consumer products are packaged in bags that can be opened and resealed without any signs of the bag having been opened. An example of such a type of bag that is commonly used for user products is a pinch bottom open mouth type of bag. Many improvements have been made to the pinch bottom bag to various properties of the bags, such as improved performance, more environmentally friendly versions, and improved sealability of the bag.

Improvements to different aspects of the bags have been made to help the bags better protect the products contained within the bags. For example, U.S. Pat. No. 3,958,749 titled "Gusseted Pinch Bottom Breakaway Pouch Bag" by Goodrich describes a multiwall bag having a plastic inner tube heat sealed at one end and manufactured integral with an outer tube housing that provides sift proof, leak proof, odor retention and sanitary packaging for a bulk product, and for subsequent uncontaminated withdrawal of the packaged products. Although the bag in Goodrich adequately protects the contents within the bag, if the bottom seal is opened and then subsequently closed, there is no way to tell if tampering of the bag has occurred.

Another improvement to bags, such as pinch bottom bags, can be found in U.S. Pat. No. 4,609,571 titled "Primer System for Grease Repellant Papers" by Tytke. Prior to Tytke, oil and grease resistant substrates used to make the bag oil and grease resistant did not accept adhesives very well, which made it difficult to economically seal bags made with these types of substrates. Tytke describes the use of a stryrene/butadiene rubber primer used to increase the surface affinity and penetrability of adhesives on substrates treated for oil and grease resistance. Once again, this improves the bag for use with end user products. If the bottom seal of the bags described in Tytke were to be subject to tampering, there still would not be a way to determine if this had occurred.

Even more environmentally friendly pinch bottom bags have been made, as described in U.S. Pat. No. 5,529,396 titled "Environmentally Friendly Pinch Bottom Bag Assembly and Method of Making" by Pryor et al. Pryor describes a pinch bottom bag assembly in which a removable plastic bag is contained within a protective outer bag that will not leave any plastic scraps trapped within the protective outer bag once the inner bag has been removed from the outer bag. No mechanism exists to assist users in determining if these bags have previously been opened either.

Numerous other improvements have been made to bags, such as being able to reclose the open mouth of the pinch bottom open mouth bags, as described in U.S. Pat. No. 4,946,289 titled "Reclosable Open Mouth Bag" by Bolling et al. Easy opening bags are described in U.S. Pat. No. 4,557,385 titled "Bag with Easy Open Line of Perforations" by Robinson and U.S. Pat. No. 6,213,644 titled "Multiply Bag with Tear Strip Opening Mechanism" by Henderson et al.

The inability to tell if the bags have been previously opened, however, continues to create a concern for many users since the contents of the bags could be the subject of tampering. Although many improvements have been made to various aspects related to bags, efforts to provide tamper evidence for bags are still needed. With the increased number of incidents of end user products being poisoned or otherwise modified, a need still exists for users to be able to tell if the package has previously been opened before. A further need exists for the tampering evident mechanisms to be easy to incorporate into the existing packaging processes and to be economical.

SUMMARY OF THE INVENTION

In view of the foregoing, an embodiment of the present invention advantageously provides end product packaging that can be fillable from the top or the bottom of the bag and includes an anti-tampering feature to alert users that tampering with the bag may have occurred. The bags can be multi-wall and provide secure enclosure of user end products contained within the bags. In addition to the end product packaging, the present invention also advantageously provides methods of forming such bags.

The present invention also advantageously provides a tamper evident feature for a bag that includes a bag body and a tamper evident seal as an embodiment of the present invention. The bag body preferably includes a pair of opposing walls. The tamper evident seal is connected to an end of at least one of the pair of walls of the bag body. The tamper evident seal preferably includes a back flap extension member and a bond enhancer. The bond enhancer is preferably positioned between the flap extension member and the selected portions of the other one of the pair of walls of the bag body to thereby enhance bonding strength so that at least one of the flap extension member and the walls tear instead of the bond enhancer separating during lifting of the flap extension member. The tearing defines a tear region so that the tear region indicates that tampering with the seal has occurred. The bond enhancer preferably comprises a primer material and an adhesive material, as described herein.

The present invention advantageously provides as another embodiment a bag with a tube body with a first end and a second end that is positioned substantially opposite the first end. The tube body can also include a front wall positioned between the first end and the second end, and a back wall positioned to face opposite the front wall between the first end and the second end. The bag advantageously provides a back flap extension member that is connected to and extends outwardly from the second end of the back wall. A front flap extension member can also be provided that connects to and extends outwardly from the second end of the front wall. A primer material is preferably positioned on and overlies an outer surface of selected portions of an outer surface of the front wall of the tube body. The primer material overlying the selected portions of the outer surface of the front wall of the tube body defines a first bond region between the front wall and the primer material. The primer material is positioned on the outer surface of the selected portions of the outer surface of the front wall so that primer material contacts substantially all of the selected second end portions of the outer surface of the front wall. An adhesive material is preferably positioned on the back flap extension member, which defines a second bond region between the primer material and the adhesive material, and the adhesive material contacts the primer material when the back flap extension member is folded over the selected second end portions of the outer surface of the front wall. The back flap extension member is preferably adapted to fold over, overlie, and adhere to the selected portions of the front wall when in a closed position, which securely closes the second end. If a front flap extension member is present, the back flap extension member is also preferably adapted to fold over, overlie, and adhere to the front flap extension member, as well as the selected portions of the front wall. The first bond region preferably is stronger than the second bond region. When the back flap extension member is liftingly separated from at least one of the front wall and the front flap extension member, regions of the selected portions of the front wall tear thereby indicating tampering with the second end of the bag has occurred.

In addition to the bags with the tamper evident feature, the present invention also advantageously provides methods of forming a bag having the tamper evident feature associated therewith. As one embodiment of the present invention, the method of forming a bag having the tamper evident feature associated therewith advantageously includes applying a primer material to overlie an outer surface of selected portions of a substrate to form a primed portion of the substrate and to thereby define a first bond region between the selected portions of the front wall and the primer material. The primer material is applied so that primer material contacts substantially all of the selected second end portions of the outer surface of the front wall. The primer fills in the pores in the substrate to provide more surface area for contacting with the adhesive material. After applying the primer, a tube body is then formed. The tube body preferably has an open end and a closed end that is positioned substantially opposite the open end. The tube body has a front wall positioned between the open end and the closed end and a back wall positioned to face opposite the front wall. The primed portion of the substrate forms selected second end portions of an outer surface of the front wall. The tube body also preferably includes a back flap extension member that is connected to and extends outwardly from the second end of the back wall. The tube body can also include a front flap extension member that is connected to and extends outwardly from the second end of the front wall. An adhesive material is applied to overlie the back flap extension member, which defines a second bond region between the primer material and the adhesive material when the back flap extension member is folded over the selected second end portions of the outer surface of the front wall and the adhesive material contacts the primer material. The back flap extension member is then folded to overlie and adhere to the front flap extension member, if present, and portions of the front wall to thereby securely close the second end. The first bond region preferably is stronger than the second bond region so that when the back flap extension member is liftingly separated from at least one of the front wall and the front flap extension member, the back flap extension members tears indicating tampering with the second end of the bag has occurred.

The tamper evident feature of the present invention can be advantageously applied to one or both ends of the bag. If only applied to one end, the other end can be closed with another type of closure. If the tamper evident feature is applied to both ends, the features typically are placed in opposite directions. For example, a first end tamper evident feature can be attached to the front wall while the second end tamper evident feature can be attached to the back wall or vice versa.

As another embodiment of the present invention, a method of indicating tampering of a bag is also provided. The method includes supplying a bag having a first end and a second end positioned substantially opposite the first end. The tube body has a front wall positioned between the first end and the second end and a back wall positioned to face opposite the front wall. The tube body further includes a second end back flap extension member connected to and extending outwardly from the second end of the back wall. The bag further includes a primer material positioned on and overlying selected second end portions of the front wall to thereby define a first bond region between the selected second end portions of the front wall and the primer material. The primer material contacts substantially all of the selected second end portions of the front wall. The primer is applied to a substrate prior to forming the tube body as a part of the printing process. The bag even further includes an adhesive material positioned on and overlying the back flap extension member to thereby define a second bond region between the primer material and the adhesive material when the back flap extension member is folded over the selected second end portions of the front wall and the adhesive material contacts the primer material. Once the bag is supplied, a hand of a user liftingly separates the second end back flap extension member from selected second end portions of the front wall of the bag. Liftingly separating the back flap extension member from the front wall causes either the back flap extension member or the selected second end portions of the front wall to tear resulting in an indication that tampering with the bag has occurred. Selected second end portions of the front wall and the back flap extension member are torn due to the separation of the layers. The step of supplying a bag with an adhesive material and a primer material can preferably include supplying a bag with the adhesive material comprising afirst polyolefin polymer and the primer material comprising a second polyolefin polymer. The second polyolefin polymer has a different chemical polyolefin composition from the first polyolefin polymer. The first polyolefin polymer preferably includes a modified polyolefin polymer and the second polyolefin preferably includes a vinyl acetate polymer. Examples of the modified polyolefin polymer can include a modified polyethylene or modified polypropylene polymer based material. Examples of the vinyl acetate polymer can include a polyvinyl acetate polymer such as a polyvinyl acetate-ethylene polymer or polyvinyl acetate-propylene polymer. Other suitable compounds will be known to those skilled in the art are to be considered within the scope of the present invention.

It is envisioned that the tamper evident packaging of the present invention can be used for any type of product that requires easy access to the contents within. It is envisioned that the tamper evident feature of the present invention can be used on both ends of the package, once the package has been filled with product. Such product uses include bags for various food items, pet food, charcoal, building materials, seed, lawn and garden supplies, and other uses as will be known to one skilled in the art and are to be considered within the scope of this invention.

For simplification of describing the invention herein, the bag is described in terms of a first end, a second end, a front wall, a back wall, and the like. These descriptions are merely illustrative of examples of possible orientation of bags of the present invention. Different orientations are possible and are to be considered within the scope of the present invention. For example, the tamper evident feature can be added to a back wall of a bag having a longer front flap extension member with the front flap extension member being folded over to overlie and adhere to the back wall of the tube body.

BRIEF DESCRIPTION OF THE DRAWINGS

So that the manner in which the features and advantages of the invention, as well as others which will become apparent, may be understood in more detail, more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

FIG. 17 is a partial cross-sectional view of the paper material prior to tearing taken along the line 17-17 of FIG. 16 in accordance with an embodiment of the present invention;

FIG. 18 is a partial cross-sectional view of the paper material after being torn taken along the line 18-18 of FIG. 16 in accordance with an embodiment of the present invention;

DETAILED DESCRIPTION

Figure 1:
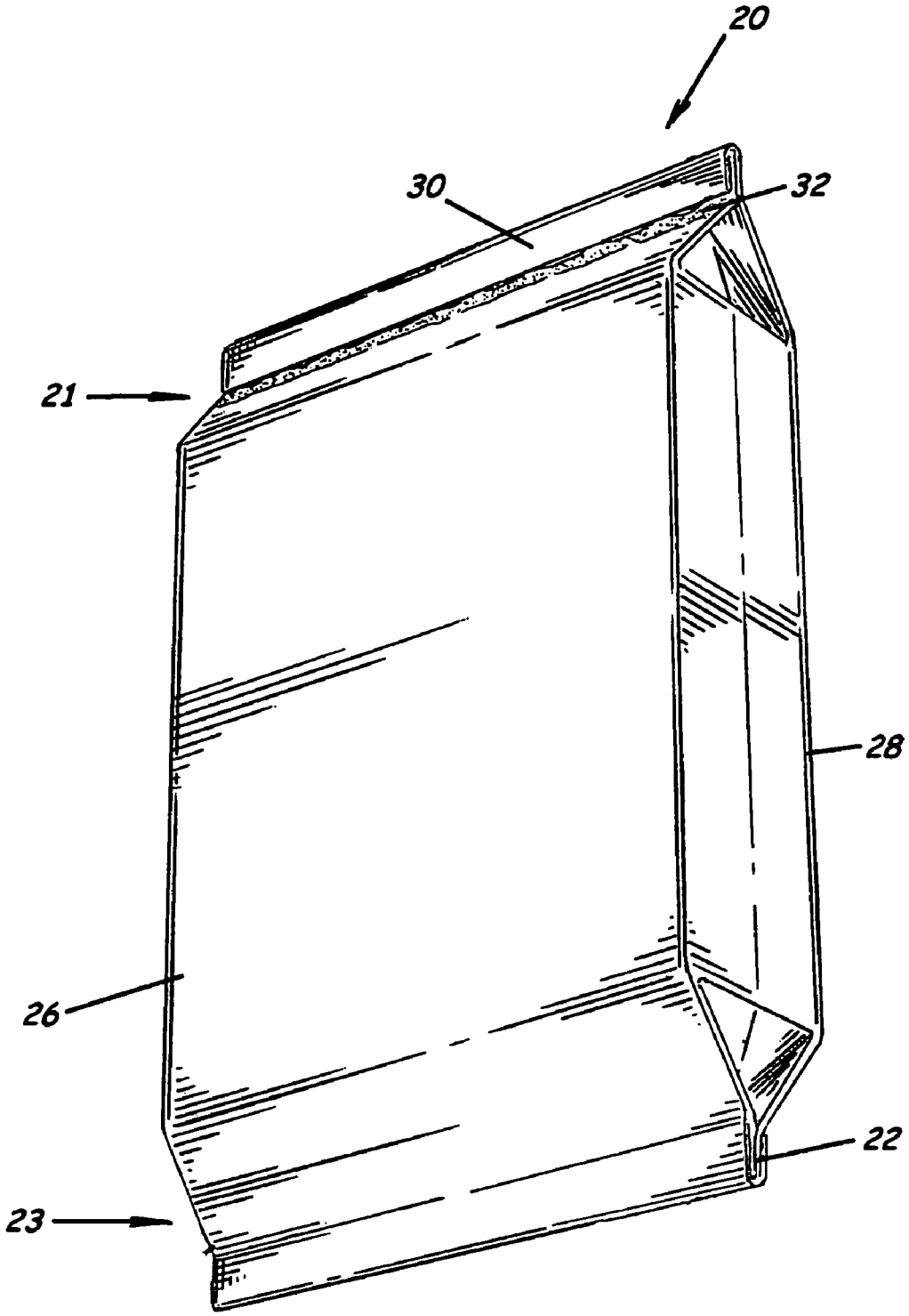
FIG. 1 is a perspective view of a bag having a tamper evident feature applied to both ends of a bag in accordance with an embodiment of the present invention.

The present invention will now be described more fully hereinafter with reference to the accompanying drawings that illustrate preferred embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. The prime notation, if used, indicates similar elements in alternative embodiments:

As shown in FIGS. 1-20, the present invention advantageously provides an end user packaging bag 20 that has a tamper evident feature that will enable users to determine if tampering has occurred with the bag 20. As an embodiment of the present invention, a tamper evident feature that includes a bag 20 that includes a bag body and a tamper evident seal is advantageously provided. The bag body preferably includes a pair of opposing walls. The tamper evident seal is connected to an end of at least one of the pair of walls of the bag body. The tamper evident seal preferably includes a back flap extension member 22 and a bond enhancer. The bond enhancer is preferably positioned between the flap extension member 22 and the selected portions of the other one of the pair of walls of the bag body. The bond enhancer enhances the bonding strength of the flap extension member 22 to the selected portions of the other one of the pair of walls of the bag body so that at least one of the flap extension member and the walls tear instead of the bond enhancer separating during lifting of the flap extension member 22. The tearing defines a tear region T so that the tear region indicates that tampering with the seal has occurred. The bond enhancer preferably comprises a primer material 34 and an adhesive material 24, as described herein. The primer material 34 is preferably positioned on and overlies the selected portions of the other one of the pair of walls and an adhesive material 24 positioned on and overlying the primer material 34. The primer material 34 is positioned so that primer material 34 contacts substantially all of the selected portions of the other one of the pair of walls of the bag body. As shown in FIG. 3A, the primer material 34 fills in the pores 29 in the bag body to provide more surface area for contacting with the adhesive material 24. The adhesive material 24 preferably includes a first polyolefin polymer and the primer material 34 preferably includes a second polyolefin polymer. The second polyolefin polymer has a different chemical polyolefin composition from the first polyolefin polymer. The first polyolefin polymer preferably includes a modified polyolefin polymer and the second polyolefin polymer preferably includes a vinyl acetate polymer. Examples of the modified polyolefin polymer can include a modified polyethylene or modified polypropylene polymer based material. Examples of the vinyl acetate polymer can include a polyvinyl acetate polymer, such as polyvinyl acetate-ethylene polymer or polyvinyl acetate-propylene polymer. Other suitable compounds will be known to those skilled in the art are to be considered within the scope of the present invention.

Figure 6:
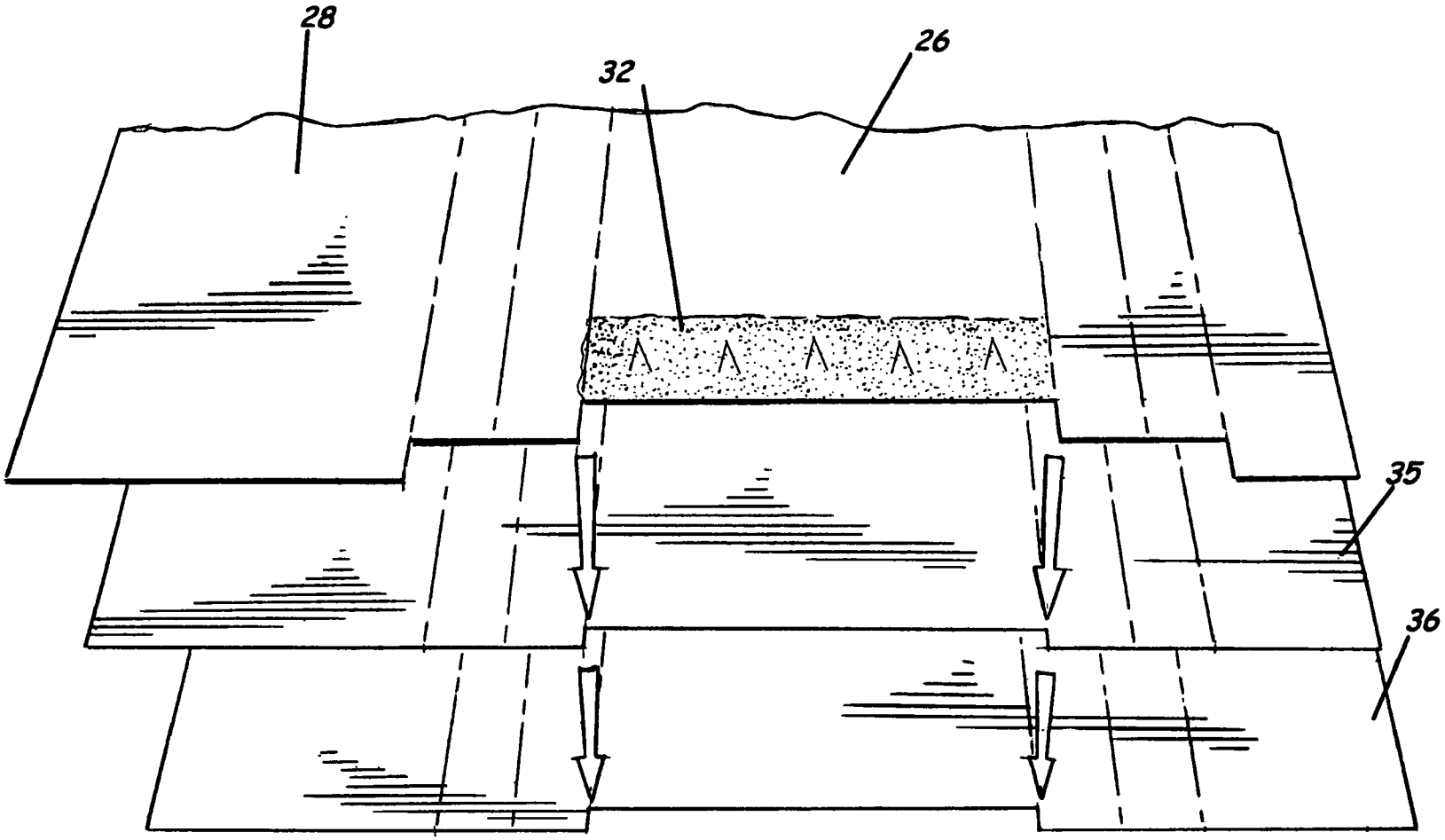
FIG. 6 is a perspective of a plurality of layers being put together to form a tube body with a primer material applied to selected portions of an outer surface of a front wall of the tube body in accordance with an embodiment of the present invention.
Figure 12:
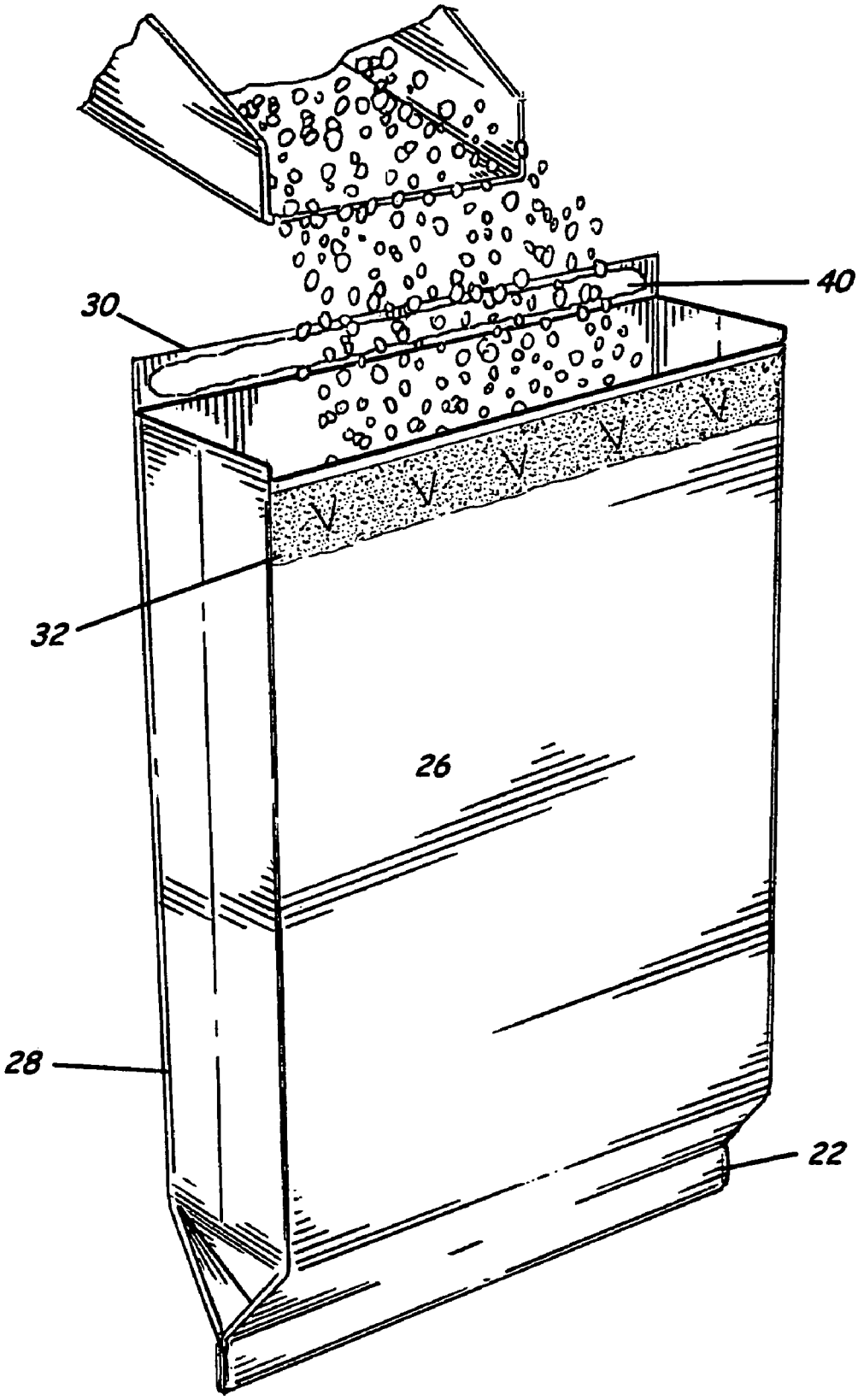
FIG. 12 is a perspective of an upright bag with open end up being filled with product in accordance with an embodiment of the present invention.

An embodiment of the present invention advantageously provides a bag 20 that can be preferably fillable from the top, as shown in FIG. 12, and includes the tamper evident feature on at least one end of the bag 20. As shown in FIG. 6, the bags 20 can be constructed with multiple or a plurality of layers or plies of material to provide secure enclosure of user end products contained within the bags 20. In addition to the end product packaging 20, the present invention also advantageously provides methods of forming such bags 20.

Figure 9:
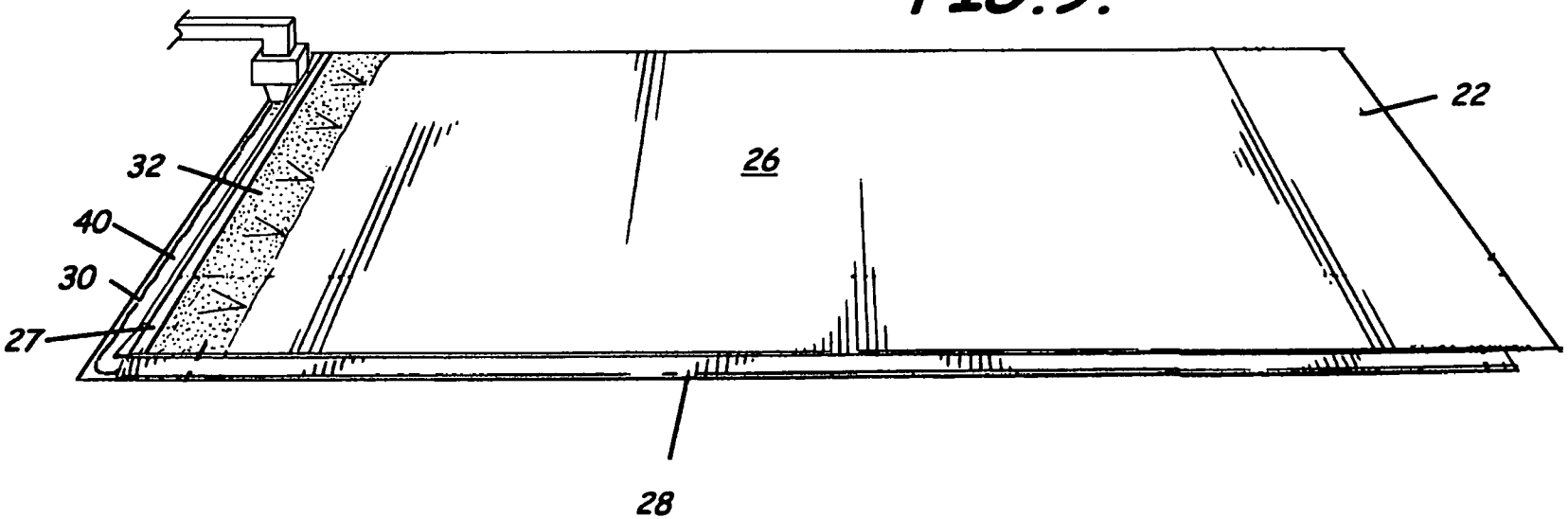
FIG. 9 is a perspective view of an adhesive material being applied to overlie and contact an extension flap member on a first end of a bag in accordance with an embodiment of the present invention.

As shown in FIGS. 1, 12, 14, and 15, the present invention advantageously provides a bag 20 with a tube body with a first end 21 and a second end 23 that is positioned substantially opposite the first end 21. The tube body also includes a front wall 26 positioned between the first end 21 and the second end 23, and a back wall 28 positioned to face opposite the front wall 26 between the first end 21 and the second end 23. The bag 20 advantageously provides a back flap extension member 22 that is connected to and extends outwardly from the second end 23 of the back wall 28. A front minor extension member 27 can also be provided that connects to and extends outwardly from the second end 23 of the front wall 26. In all embodiments, the back flap extension member 22 preferably has a longer longitudinal extent than the front minor extension member 27. A primer material 34 is preferably positioned on and overlies an outer surface of selected second end portions of an outer surface of the front wall 26 of the tube body. The primer material 34 is positioned so that primer material 34 contacts substantially all of the selected second end portions of the outer surface of the front wall 26. Selected second end portions of the outer surface of the front wall 26 generally describes any region such as below a medial region of the front wall 26 in which the back flap extension member 22 can overlie. The primer material 34 overlying the selected second end portions of the outer surface of the front wall 26 of the tube body defines a first bond region between the front wall 26 and the primer material 34. The back flap extension member 22 is preferably adapted to fold over, overlie, and adhere to the selected second end portions of the front wall 26 when in a closed position, which securely closes the second end 23. An adhesive material 24 is preferably positioned on and overlies an inner surface of the back flap extension member 22 as shown in FIG. 9, which when the back flap extension member 22 is folded over defines a second bond region between the primer material 34 and the adhesive material 24 and the adhesive material 24 contacts the primer material 34. If a front minor extension member 27 is present, the back flap extension member 22 is also preferably adapted to fold over, overlie, and adhere to the front minor extension member 27, as well as the selected second end portions of the front wall 26. The first bond region is preferably stronger than the second bond region. When the back flap extension member 22 is liftingly separated from at least one of the front wall 26 and the front minor extension member 27, at least one of the selected second end portions of the front wall 26 and the back flap extension member 22 tears thereby indicating tampering with the second end 23 of the bag 20 has occurred.

The primer material preferably defines a liquid surface treatment in the selected second end portions of the outer surface of the front wall to promote further bonding between the adhesive material and the selected second end portions of the outer surface of the front wall when the back flap extension member is folded over the front flap extension member, if present, and the selected second end portions of the outer surface of the front wall and the adhesive material contacts the primer material. The outer surface of the front wall in the selected second end portions preferably includes at least one outermost layer of porous material. The primer material of the liquid surface treatment penetrates into the porous material of the at least one outermost layer of the outer surface to define a primer integration zone on the outer surface of the front wall. The primer integration zone also includes adhesive material contacting the porous material of the outermost layer of the outer surface.

Figure 16:
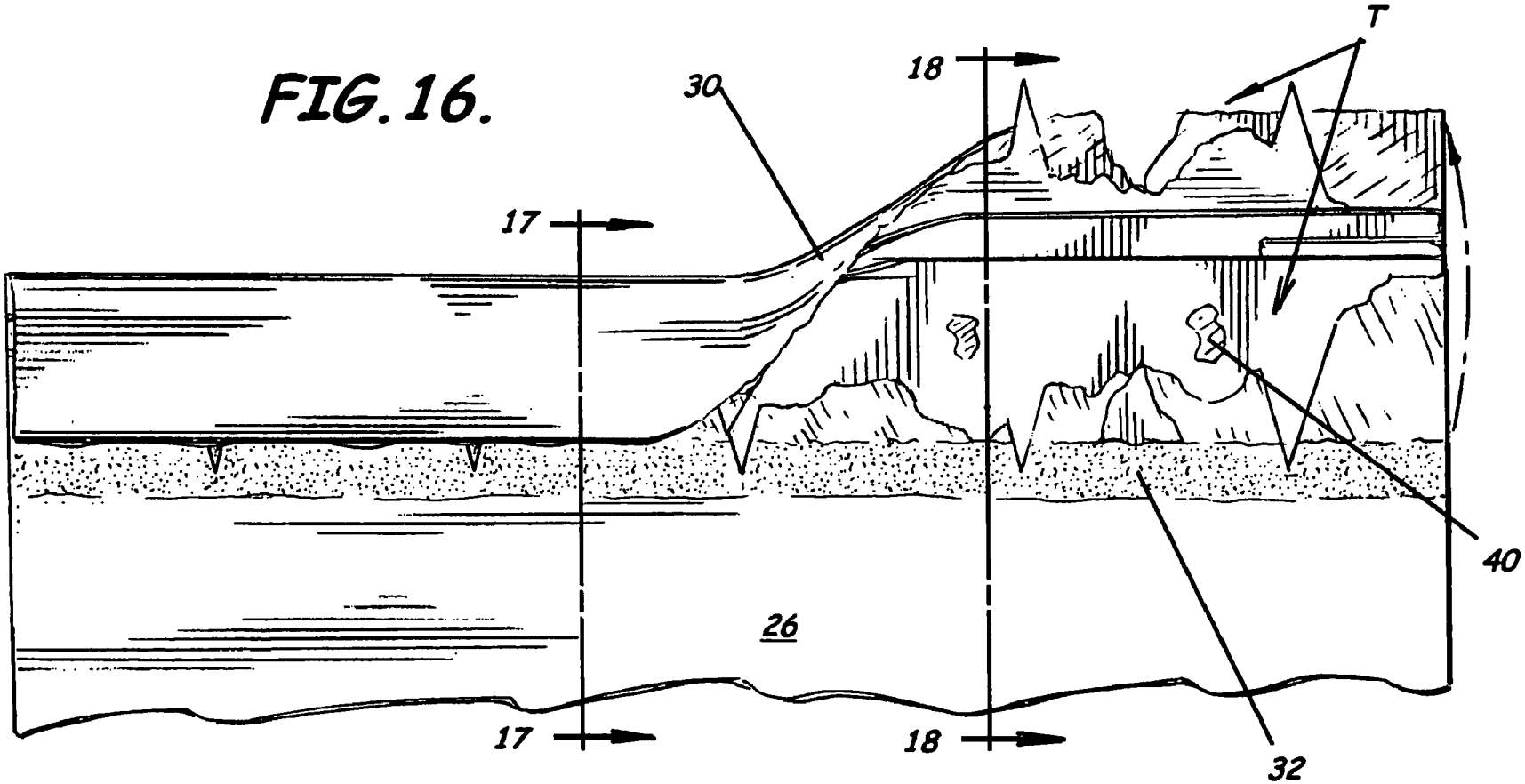
FIG. 16 is an enlarged fragmentary perspective of a bag being tampered with or opened showing paper material torn according to an embodiment of the present invention.

As shown in FIGS. 16 and 18, at least one of the selected second end portions of the front wall 26 and the back flap extension member 22 can tear within a tear region T. The tearing is not necessarily in a uniform pattern, but rather arbitrary. The tears occur within the tear region T.

In all embodiments of the present invention, the primer material 34 is preferably an adhesive capable of increasing the bonding strength of the adhesive material 24. The adhesive material 24 preferably includes a first polyolefin polymer and the primer material 34 preferably includes a second polyolefin polymer. The second polyolefin polymer preferably has a different chemical polyolefin composition from the first polyolefin polymer. The first polyolefin polymer preferably includes a modified polyolefin polymer and the second polyolefin polymer preferably includes a vinyl acetate polymer. Examples of the modified polyolefin polymer can include a modified polyethylene or modified polypropylene polymer based material. Examples of the vinyl acetate polymer can include a polyvinyl acetate polymer, such as polyvinyl acetate-ethylene polymer or polyvinyl acetate-propylene polymer. Suitable adhesives and primers for this application have been developed by HB Fuller Company with its corporate headquarters at 1200 Willow Lake Boulevard, P.O. Box 64683, St. Paul, Minn. 55164-0683. For example, in particular preferred embodiments, an adhesive material 24 identified commercially as HL-0757, which is a polyethylene homopolymer, and a primer material 34 identified commercially as WD-3700, which is a polyvinyl acetate-ethylene copolymer, both available from HB Fuller Company, can be used in the present invention. Other suitable materials for the adhesive material 24 and the primer material 34 will be known to those skilled in the art and are to be considered within the scope of the present invention.

Figure 4:
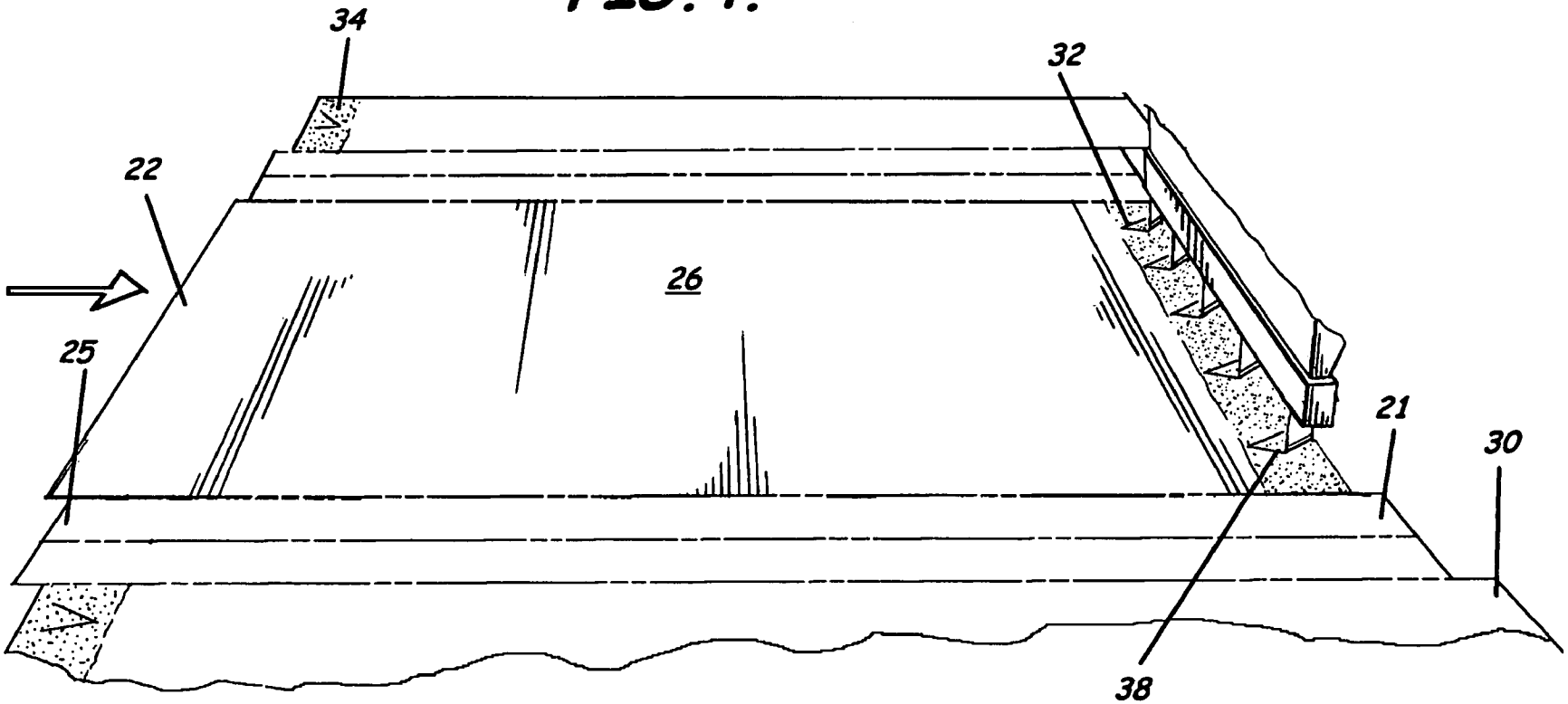
FIG. 4 is a perspective view of the bag showing a plurality of elongate slits being cut on selected portions of the front wall in accordance with an embodiment of the present invention.
Figure 5:
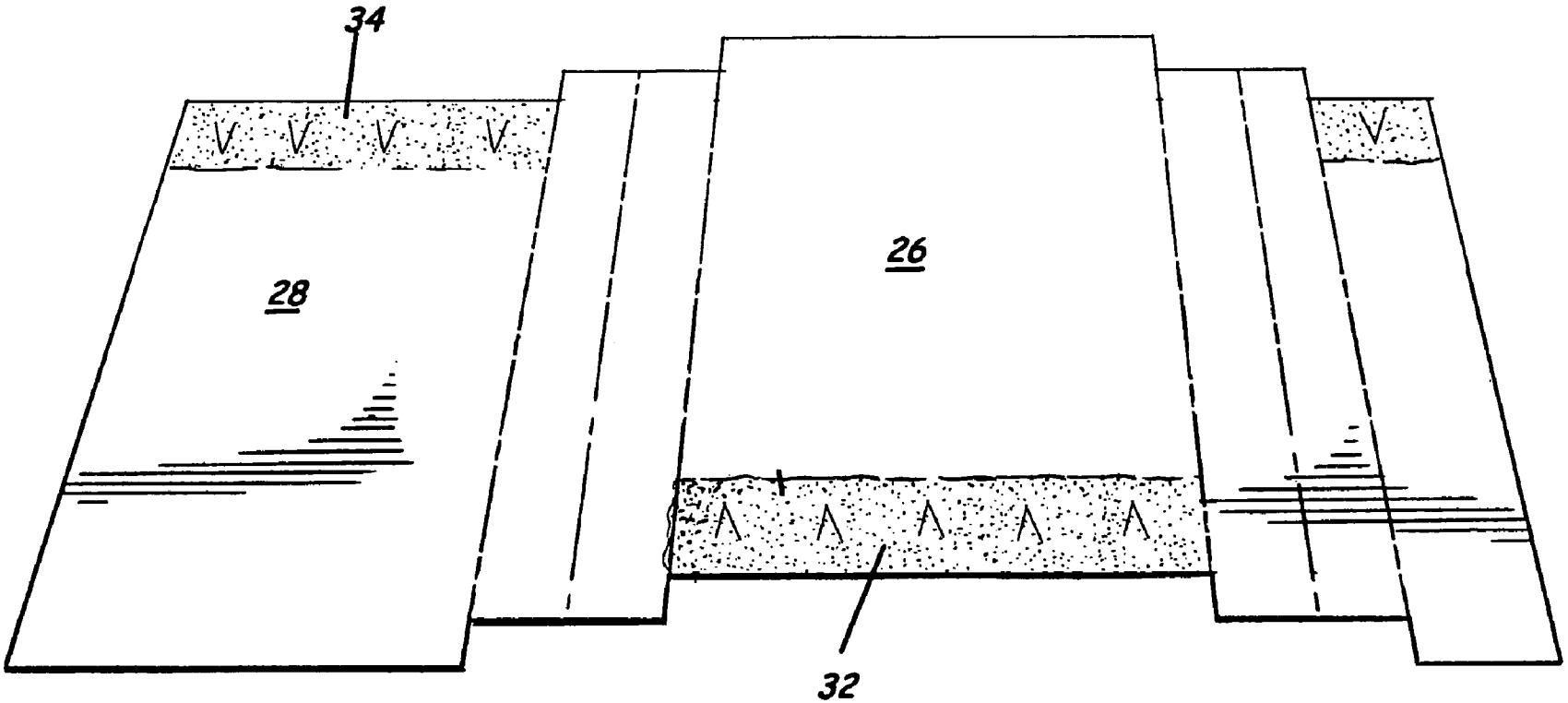
FIG. 5 is a perspective view of an outer layer used to form a bag with a plurality of elongate slits cut within portions of the bag with primer previously applied in accordance with an embodiment of the present invention.

An advantageous feature of the present invention includes a bag 20 having a plurality of auxiliary apertures 38 formed within selected portions of the front wall 26 and positioned to contact the primer material 34, as shown in FIG. 4. When multiple layers are used in forming the tube body, the plurality of auxiliary apertures 38 are preferably cut only in outer most layer of the tube body. The plurality of auxiliary apertures 38 weaken the paper in the selected portions of the front wall 26 to allow for easier tearing of the front wall 26 when the back flap extension member 22 is liftingly separated from the selected portions of the front wall 26. The plurality of auxiliary apertures 38 preferably comprise a plurality of elongate slits and are preferably spaced apart across a width of the front wall 26 of the tube body, as shown in FIG. 4. The auxiliary apertures 38 can be formed in all embodiments of the present invention. FIG. 5 illustrates the auxiliary apertures 38 formed within the outer layer used to form the tube body.

In all embodiments of the present invention, it is preferable for an outer layer of the tube body to be formed of a material capable of being torn due to the material being weaker than the first bond region. The material capable of being torn is preferably selected from at least one of the following: a paper material, a metal foil material, and a plastic material.

Figure 14:
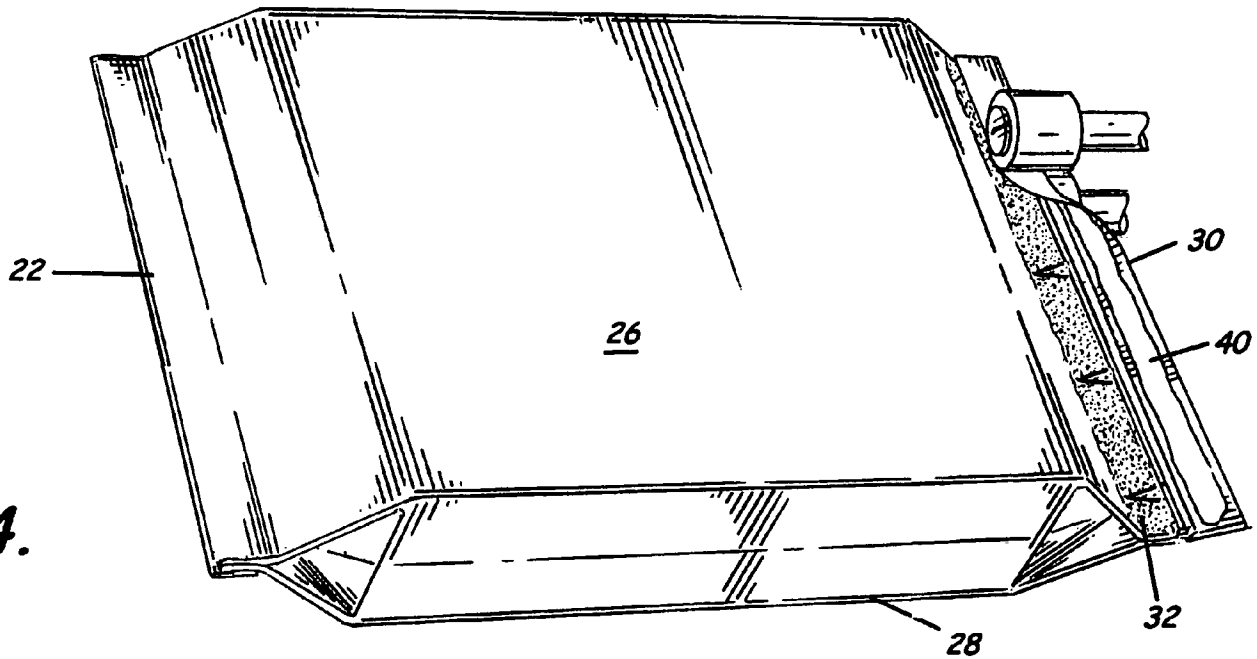
FIG. 14 is a perspective view of the opened end with a pre-applied adhesive material being sealed by a user in accordance with an embodiment of the present invention.
Figure 15:
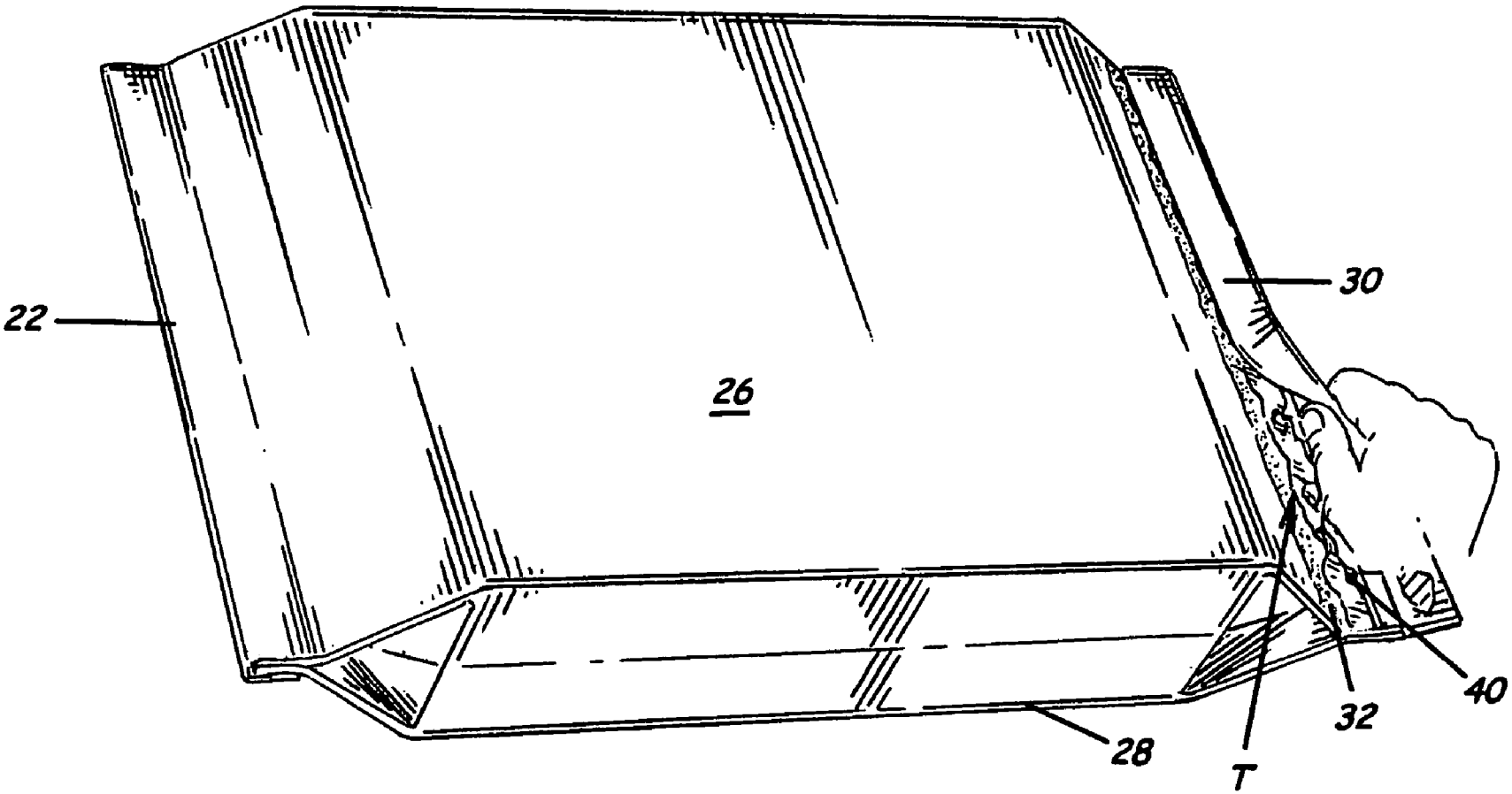
FIG. 15 is a perspective of a bag showing one end being torn open in accordance with an embodiment of the present invention.

If the tamper evident feature or seal is not desired to be placed on both ends of the bag 20 of the present invention, a different type of closure on one end can be used. For example, a pinch bottom can be formed on the second end 23 of the bag 20 and a reclosable sealer can be placed on the first end 21 of the bag. If the tamper evident feature is placed on both ends of the bag 20, the tamper evident features are positioned opposite each other with one tamper evident feature being installed on selected portions of the front wall 26 and the other being installed on selected portions of the back wall 28 as shown in FIGS. 1, 14, and 15. The tamper evident feature for each end can be placed on either the front wall 26 or the back wall 28, with the other tamper evident feature being located on the opposite wall.

The multiple layers of materials forming the tube body can have different lengths. In all embodiments of the present invention, the tube body further includes a plurality of layers with at least one of the plurality of layers having a peripheral end portion that extends past other peripheral end portions of other layers. The back flap extension member 22 is connected to the at least one layer having a peripheral end portion that extends past the other peripheral end portions of the other layers. The at least one layer can include an innermost layer of the plurality of layers.

Figure 10:
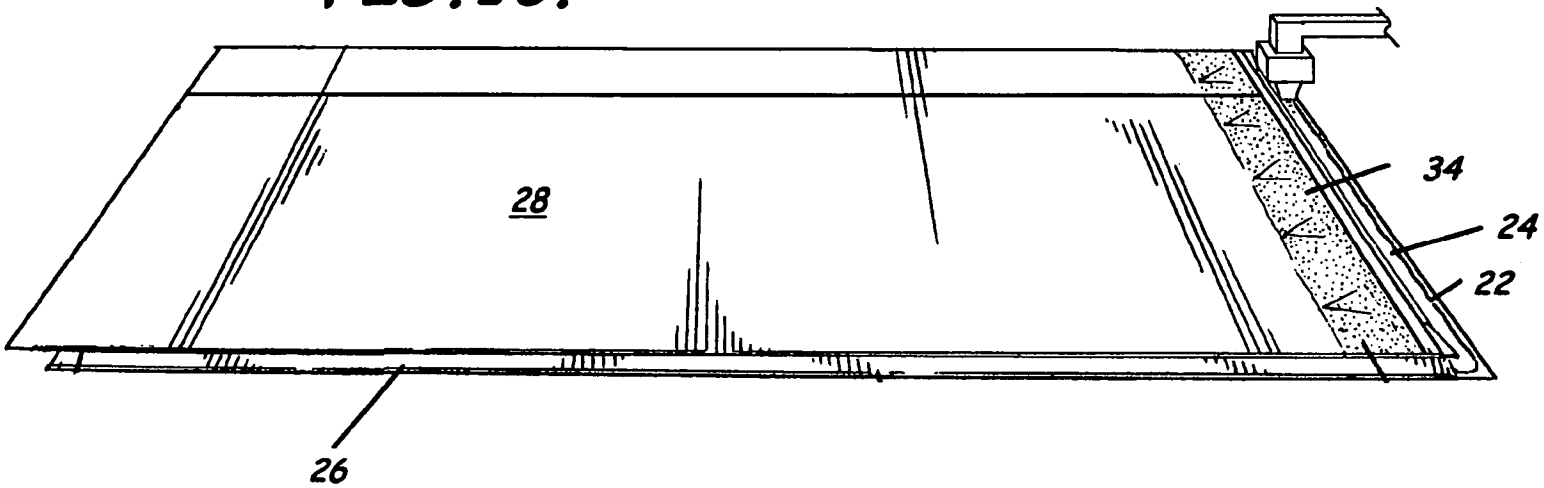
FIG. 10 is a perspective view of an adhesive material being applied to overlie and contact an extension flap member on a second end of a bag in accordance with an embodiment of the present invention.

The adhesive material 24 is preferably positioned on the back flap extension member 22 with a preselected spray pattern, as illustrated in FIGS. 9 and 10. The preselected spray pattern can be selected from at least one of the following: spiral spray, flood coat, swirl spray, atomized spray, and slot coating.

Figure 13:
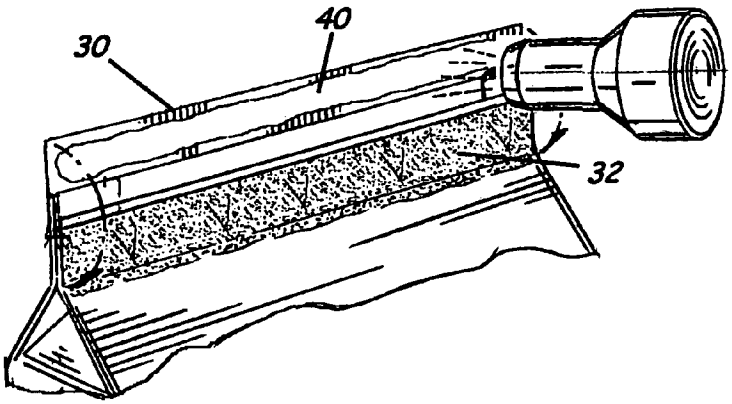
FIG. 13 is a fragmentary perspective view of an opened end of a bag with pre-applied adhesive being heated by a user in accordance with an embodiment of the present invention.

The bag 20 of the present invention can include a pre-applied primer material 32 positioned on an outer surface of selected first end portions of the back wall 28 and a pre-applied adhesive material 40 positioned on to overlie a first end front flap extension member 30 as shown in FIG. 12. The pre-applied primer material 32 is applied so that pre-applied primer material 32 contacts substantially all of the outer surface of the selected first end portions of the back wall 28. The pre-applied primer material 32 and the outer surface of the selected first end portions of the back wall 28 define a first end first bond region between the back wall and the pre-applied primer material. The pre-applied adhesive material 40 and the first end front flap extension member 30 define a first end second bond region between the pre-applied adhesive material 40 and the pre-applied primer material 32. This feature enables users to fill the bag 20 with their own products at their facility, fold the first end 21 of the tube body, and then melt and press the pre-applied primer material 32 and pre-applied adhesive material 40 to reactivate the materials to securely seal the first end 21 of the tube body as illustrated in FIGS. 13-14. The first end first bond region is preferably stronger than the first end second bond region. When the front flap extension member 30 liftingly separates from the selected first end portions of the outer surface of the back wall 28 at least one of the selected first end portions of the outer surface of the back wall 28 and the first end front flap extension member 30 tears, which indicates that tampering with the first end of the bag has occurred.

Figure 11:
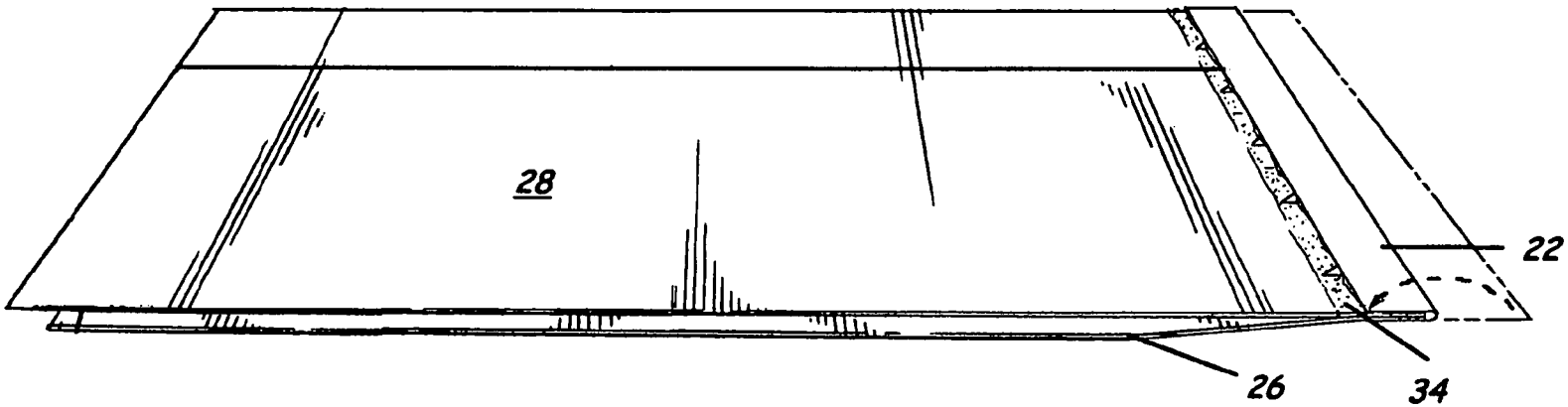
FIG. 11 is a perspective view of a second end of a bag being folded over in accordance with an embodiment of the present invention.

As another embodiment of the present invention, a bag 20 is advantageously provided that has great strength in the closure area to securely retain product materials within the bag 20. The bag 20 preferably includes a tube body having a first end 21 and a second end 23. The second end 23 is positioned substantially opposite the first end 21. The tube body also includes a front wall 26 positioned between the first end 21 and the second end 23, and a back wall 28 positioned to face opposite the front wall 26 between the first end 21 and the second end 23. A back flap extension member 22 is provided that connects to and extends outwardly from the second end 23 of the back wall 28. The back flap extension member 22 advantageously folds over and overlies the front minor extension member 27 and selected second end portions of the front wall 26. A primer material 34 is preferably positioned on and overlies selected portions of an outer surface of the front wall 26 to define a first bond region between the selected portions of the outer surface of the front wall 26 and the primer material 34. The primer material 34 is preferably positioned so that primer material 34 contacts substantially all of the selected portions of the outer surface of the front wall 26. An adhesive material 24 is preferably positioned on and overlies the back flap extension member 22 to thereby define a second bond region between the primer material 34 and the adhesive material 24 when the back flap extension member 22 is folded over selected second end portions of the front wall 26 and the adhesive material 24 contacts the primer material 34, as shown in FIG. 11. The primer material 34 and adhesive material 24 adhere the back flap extension member 22 to the selected portions of the outer surface of the front wall 26 to thereby securely close the second end 23 of the tube body. The first bond region is stronger than the second bond region. When the back flap extension member 22 is liftingly separated from the front wall 26, at least one of the back flap extension member 22 and the selected second end portions of the outer surface of the front wall 26 tear to thereby indicate tampering with the second end 23 of the bag 20 has occurred.

The bag 20 can also include a front minor extension member 27 that is connected to and extends outwardly from the second end 23 of the front wall 26 in addition to the back flap extension member 22. If the front minor extension member 27 is present, the back flap extension member 22 also folds over and overlies the front minor extension member 27, along with portions of the front wall 26. The back flap extension member 22 also adheres to the front minor extension member 27, along with portions of the front wall 26.

Another embodiment of the bag 20 of the present invention is advantageously provided. In this embodiment, the bag 20 preferably includes a tube body with a first end 21 and a second end 23. The second end 23 is positioned substantially opposite the first end 21. The tube body also includes a front wall 26 positioned between the first end 21 and the second end 23, and a back wall 28 positioned to face opposite the front wall 26 between the first end 21 and the second end 23. A back flap extension member 22 is provided that connects to and extends outwardly from the second end 23 of the back wall 28. A primer material 34 is preferably positioned on and overlies selected portions of an outer surface of the front wall 26 to thereby define a first bond region between the front wall 26 and the primer material 34. The primer material 34 is preferably positioned so that primer material 34 contacts substantially all of the selected portions of the outer surface of the front wall 26. An adhesive material 24 is preferably positioned on and overlies the primer material 34 to thereby define a second bond region between the primer material 34 and the adhesive material 24. The back flap extension member 22 is preferably adapted to fold over, overlie, and adhere to portions of the front wall 26 when in a closed position to thereby securely close the second end 23. The first and second bond regions provide increased strength in the seal to ensure that the contents of the bag 20 are retained securely within the bag. A front minor extension member 27 can also be provided that connects to and extends outwardly from the second end 23 of the front wall 26. If the front flap extension member 27 is present, the back flap extension member 22 also folds over and overlies the front flap extension, along with portions of the front wall 26 and the back flap extension member 22 adheres to the front flap extension, along with portions of the front wall 26.

As another embodiment of the present invention, a bag 20 with the tamper evident feature applied to both sides is advantageously provided, as illustrated in FIGS. 1 and 15. This bag 20 preferably includes a tube body having a first end 21 and a second end 23. The second end 23 is positioned substantially opposite the first end 21. The tube body also includes a front wall 26 positioned between the first end 21 and the second end 23, and a back wall 28 positioned to face opposite the front wall 26 between the first end 21 and the second end 23. A first end front flap extension member 30 connected to and extending outwardly from the first end 21 of the front wall 26 is provided. A first end primer material 34 is preferably positioned on and overlies selected upper portions of an outer surface of the back wall 28 to thereby define a first end first bond region between the selected first end portions of the outer surface of the back wall 28 and the first end primer material 32. The first end primer material 34 is applied so that first end primer material 34 contacts substantially all of the selected second end portions of the outer surface of the back wall 28. The first end front flap extension member 30 is preferably adapted to fold over, overlie, and adhere to the selected first end portions of the back wall 28 when in a closed position to thereby securely close the first end 21. A first end adhesive material 32 is preferably positioned on and overlies the first end back flap extension member 30 to thereby define a first end second bond region between the first end primer material 32 and the first end adhesive material 40 when the first end front flap extension member 30 is folded over the selected first end portions of the back wall 28 and the first end adhesive material 40 contacts the first end primer material 32. The first end first bond region is preferably stronger than the first end second bond region so that when the first end front flap extension member 30 liftingly separates from the selected first end portions of the back wall 28, at least one of the selected first end portions of the back wall 26 and the first end front flap extension member 30 tears thereby indicating tampering with the first end 21 of the bag 20 has occurred. A second end back flap extension member 22 is also provided that connects to and extends outwardly from the second end 23 of the back wall 28. A second end primer material 34 is preferably positioned on and overlies selected second end portions of the front wall 26 to thereby define a second end first bond region between the selected second end portions of the front wall 26 and the second end primer material 34. The second end primer material 34 is applied so that second end primer material 34 contacts substantially all of the selected second end portions of the front wall 26. The second end back flap extension member 22 is adapted to fold over, overlie, and adhere to the selected upper portions of the front wall 26 when in a closed position to thereby securely close the second end 23. A second end adhesive material 24 is preferably positioned on and overlies the second end back flap extension member 22 to thereby define a second end second bond region between the second end primer material 34 and the second end adhesive material 24. The second end first bond region is preferably stronger than the second end second bond region so that when the second end back flap extension member 22 liftingly separates from the selected second end portions of the front wall 26, the selected second end portions of the front wall 26 tear thereby indicating tampering with the second end 23 of the bag 20 has occurred.

The first end adhesive material preferably also contacts and overlies the selected first end portions of the outer surface of the back wall when the first end front flap extension member is folded over the selected first end portions of the outer surface of the back wall. The second end adhesive material preferably also contacts and overlies the selected second end portions of the outer surface of the front wall when the second end back flap extension member is folded over the selected second end portions of the outer surface of the front wall.

For simplification of describing the invention herein, the bag 20 is described in terms of a first end 21, a second end 23, a front wall 22, a back wall 28, and the like. These descriptions are merely illustrative of examples of a possible orientation of the bags of the present invention. Different orientations are possible and are to be considered within the scope of the present invention. For example, the tamper evident feature can be added to a back wall 28 of a bag 20 having a longer front minor extension member 27 with the front minor extension member 27 being folded over to overlie and adhere to the back wall 28 of the tube body. As another example, a first end or an upper end generally refer to the top of the bag, and a second end or a lower end generally refer to the bottom of the bag.

Figure 2:
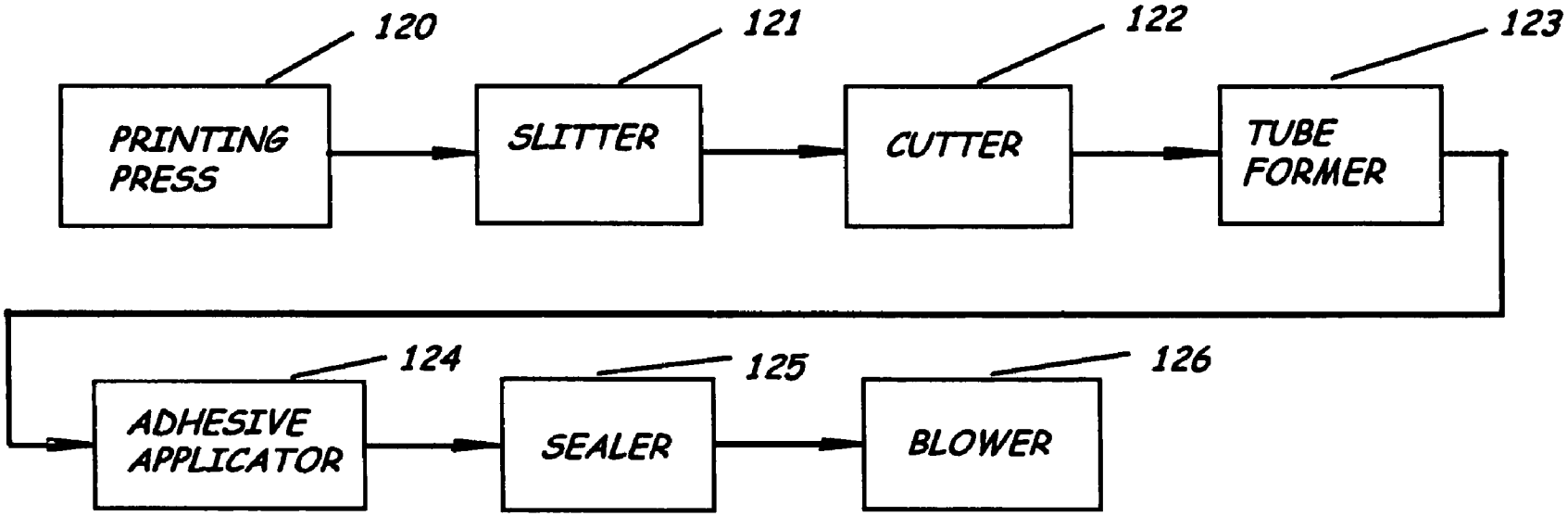
FIG. 2 is a block diagram of the method of forming a bag having a tamper evident feature applied to at least one end of a bag in accordance with an embodiment of the present invention.
Figure 7:
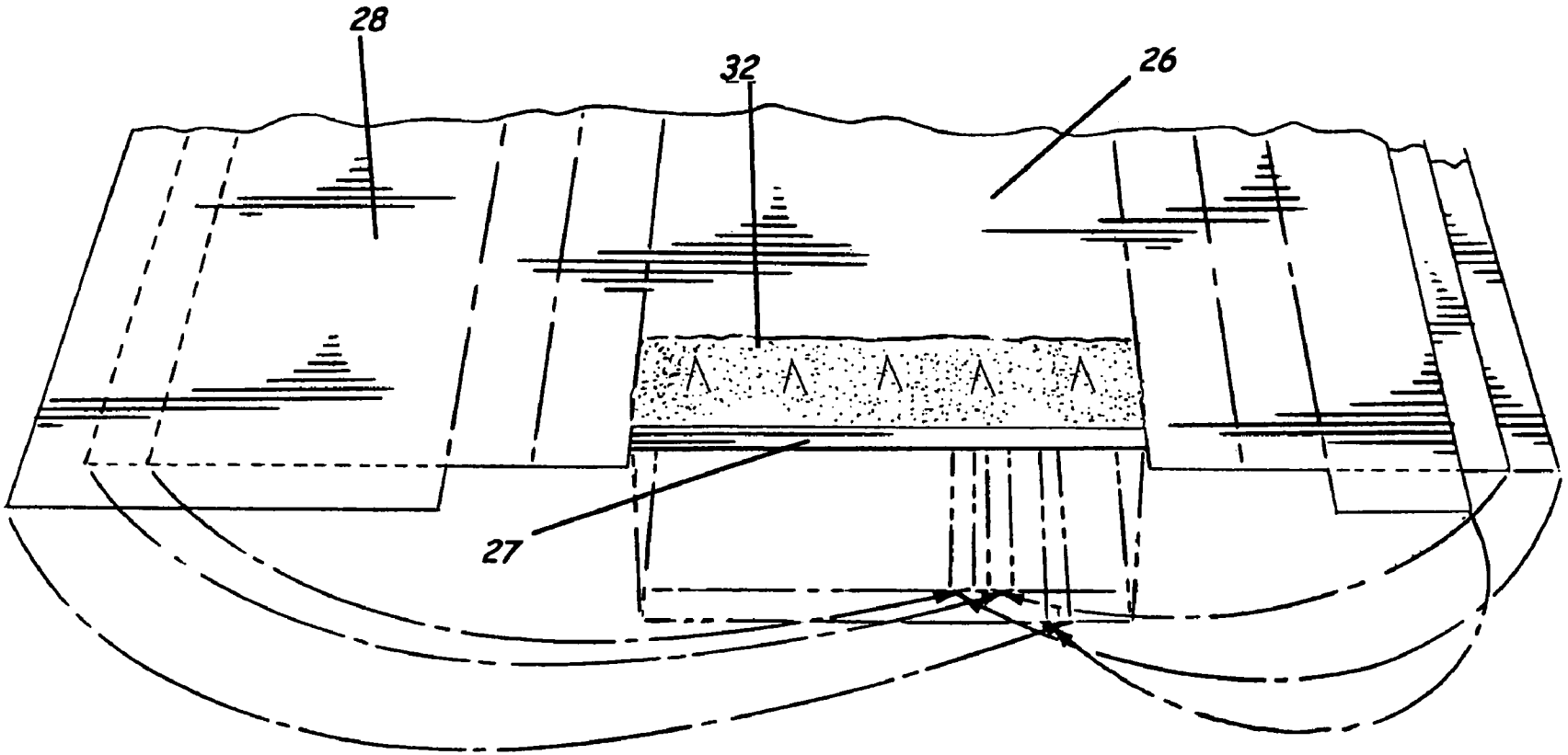
FIG. 7 is a perspective of a tube body being formed with a primer material applied to selected portions of an outer surface of a front wall of the tube body in accordance with an embodiment of the present invention.
Figure 8:
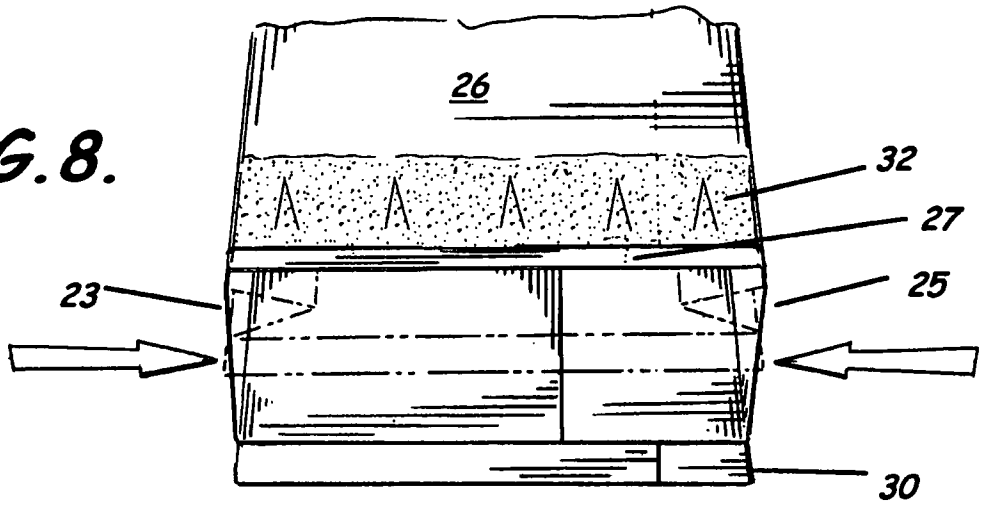
FIG. 8 is a perspective view of a bag with one end being folded and sealed in accordance with an embodiment of the present invention.

In addition to the bags 20 with the tamper evident feature, the present invention also advantageously provides methods of forming a bag 20 having the tamper evident feature associated therewith as described in FIGS. 2 and 13. As one embodiment of the present invention, the method of forming a bag 20 having the tamper evident feature associated therewith advantageously includes applying a primer material 34 forming a tube body. The primer material 34 is applied to selected portions of a substrate to form a primed portion of the substrate and to thereby define a first bond region between the selected second end portions of the front wall 26 and the primer material 34. The primed portion of the substrate can be used to form selected second end portions of the front wall. The primer material 34 is applied so that primer material 34 contacts substantially all of the selected portions of the substrate. As shown in FIG. 3A, the primer material 34 fills in the pores 29 in the substrate to provide more surface area for contacting with an adhesive material 24. The tube body is then formed, which typically includes slitting, cutting, and then forming the tube body as shown in blocks 121, 122, and 123 of FIG. 2. The tube body preferably has an open end and a closed end that is positioned substantially opposite the open end. The tube body has a front wall 26 positioned between the open end and the closed end and a back wall 28 positioned to face opposite the front wall 26, as shown in FIG. 7. The tube body also preferably includes a back flap extension member 22 that is connected to and extends outwardly from the second end 23 of the back wall 28. The tube body can also include a front minor extension member 27 that is connected to and extends outwardly from the second end 23 of the front wall 26. The adhesive material 24 is applied to overlie the back flap extension member 22 (block 124 of FIG. 2), which defines a second bond region between the primer material 34 and the adhesive material 24 when the back flap extension member 22 is folded and the adhesive material 24 contacts the primer material 34. FIG. 8 illustrates a second end 23 of the tube body prior to applying the adhesive material 24. The back flap extension member 22 is then folded to overlie and adhere to the front minor extension member 27, if present, and selected second end portions of the front wall 26 to thereby securely close the second end 23 (block 125 of FIG. 2). The first bond region preferably is stronger than the second bond region so that when the back flap extension member 22 is liftingly separated from at least one of the front wall 26 and the front minor extension member 27, at least one of the back flap extension member 22 and the selected second end portions of the front wall 26 tears indicating tampering with the second end 23 of the bag 20 has occurred.

In all embodiments of the present invention, the methods of forming the bag 20 can include the step of drying the primer material 34 prior to forming the tube body.

Figure 3:
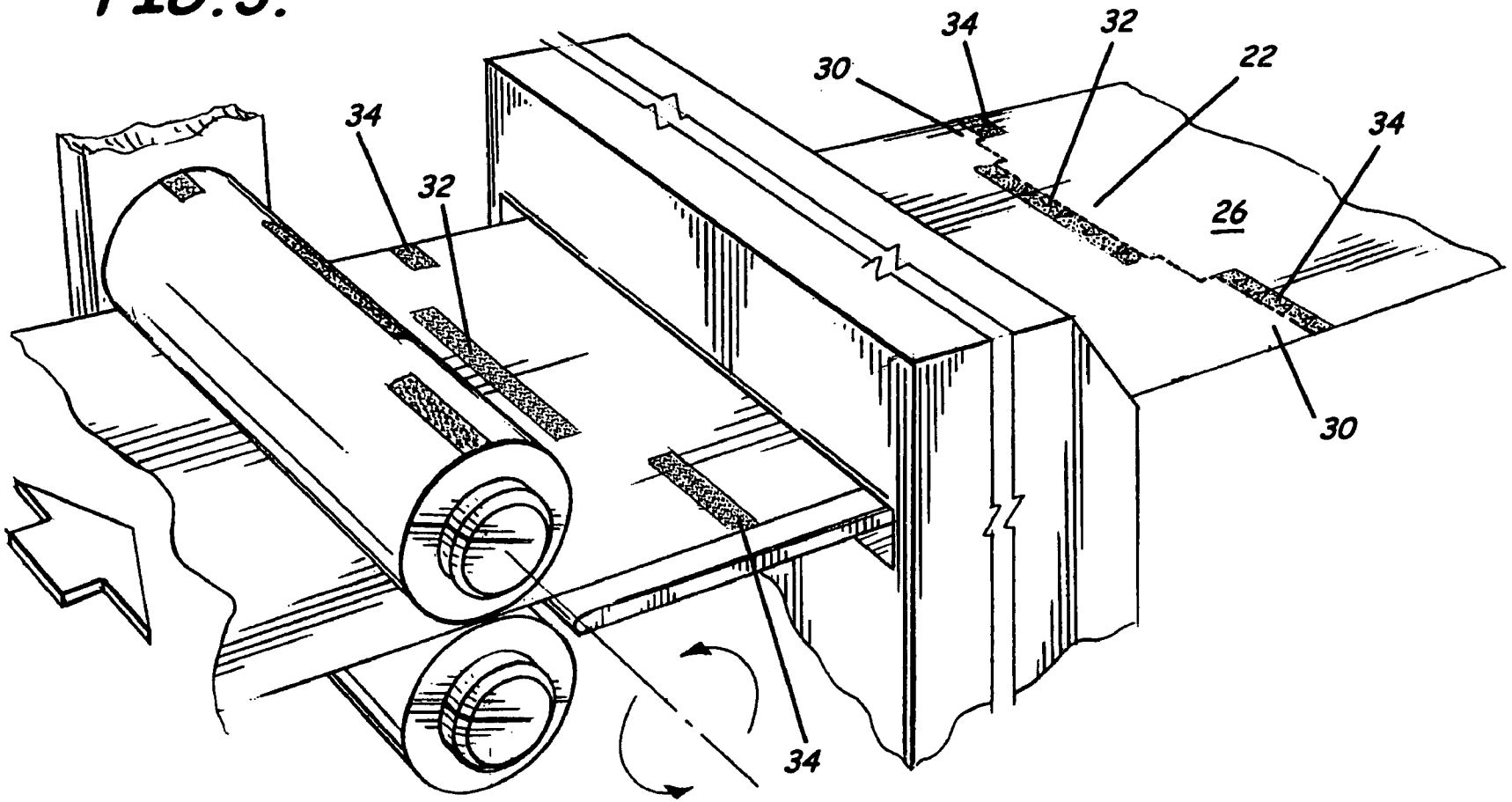
FIG. 3 is a fragmentary perspective view of a primer material being applied by printing to an outer surface of an outer layer used to form a bag in accordance with an embodiment of the present invention.
Figure 3A:
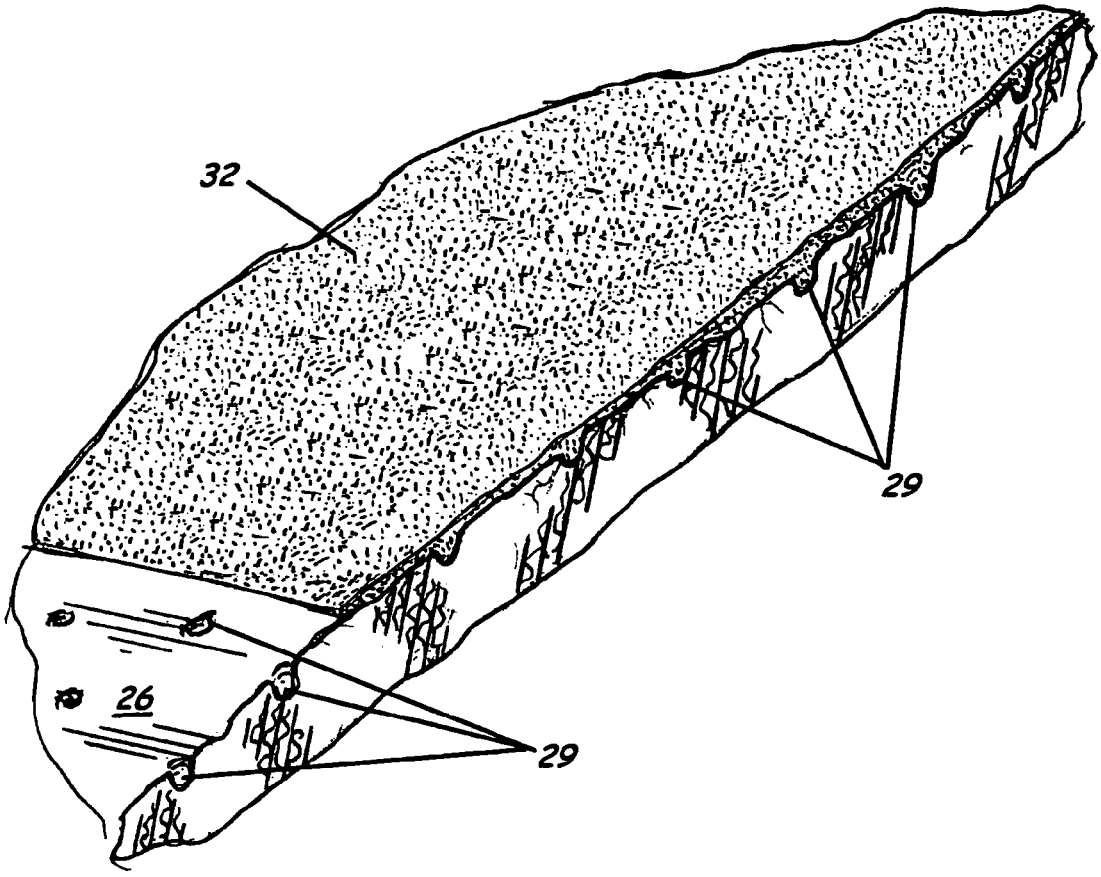
FIG. 3A is an enlarged cross-sectional view of the primer material on an outer surface of an outer layer used to form a bag in accordance with an embodiment of the present invention.
Figure 19:
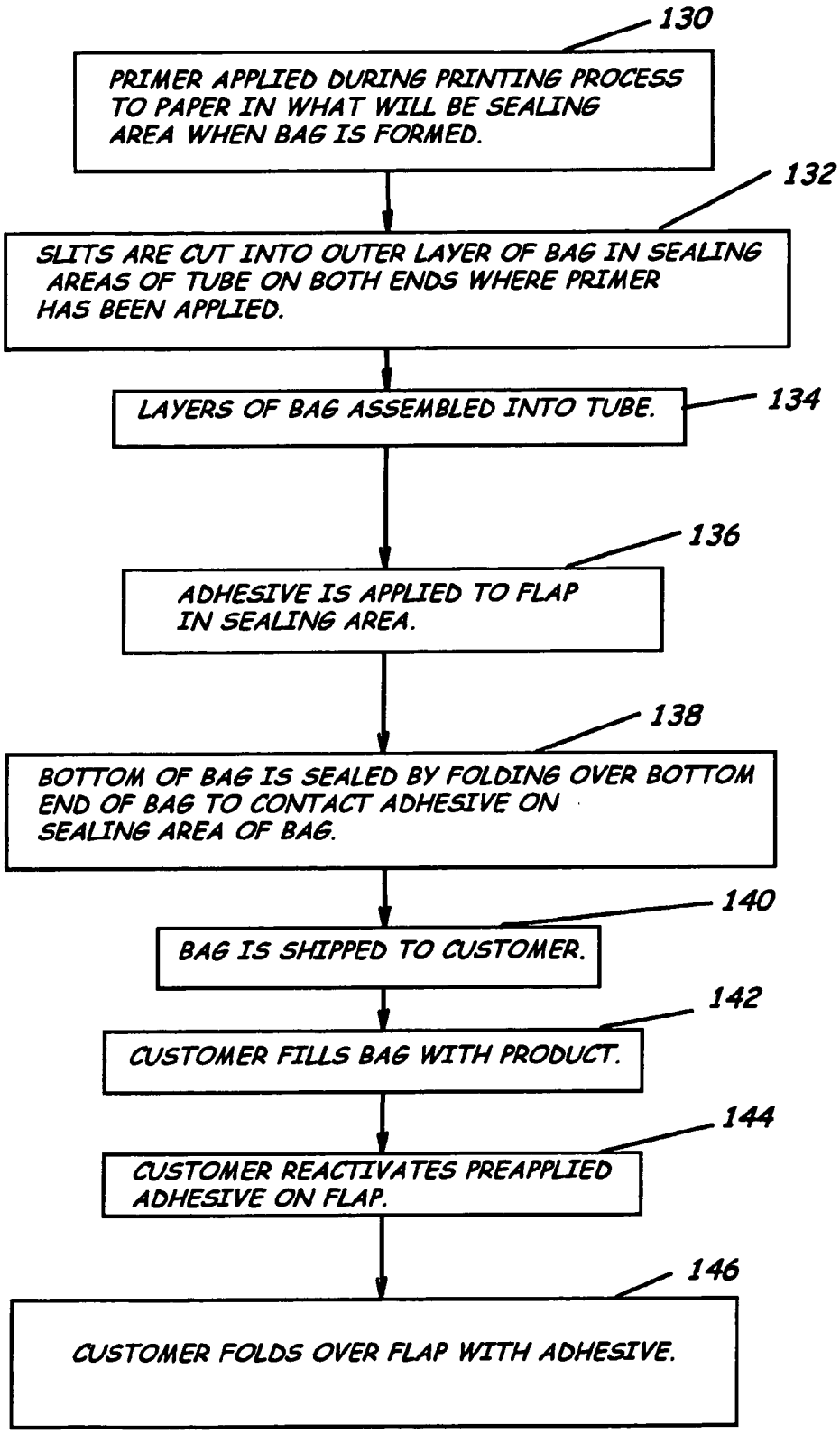
FIG. 19 is a flow diagram of a method of producing a bag with a tamper evident feature according to an embodiment of the present invention.

A preferable method of applying the primer material 34 in all embodiments includes printing the primer material 34 on the selected portions of the outer surface of the front wall 26 as shown in FIG. 3 and described in block 130 of FIG. 19. The preferable method of printing the primer material 34 is by flexography, however other application methods will be known to those skilled in the art and are to be considered within the scope of the present invention. As shown in FIG. 3A, the primer material 34 fills in any pores on the substrate to provide a more uniform surface in which to contact the adhesive material 24. The filled pores allow for essentially all of the surface area of the substrate to be used for bonding, as opposed to only the portions of the substrate that would otherwise contact the adhesive material 24. For example, with the filled pores, substantially all of the surface area of the substrate can be used for bonding, whereas previously significantly less of the surface area was actually used for bonding since the adhesive material 24 did not reach into the pores of the substrate. The primer material 34 preferably covers the entire surface area of the underlying substrate. If the primer material 34 does not sufficiently cover the surface area, then there is not sufficient contact with the adhesive material 24 thereby reducing the bonding strength between the primer material 34 and the adhesive material 24.

The step of forming a tube body preferably includes forming a plurality of auxiliary apertures 38 comprising a plurality of elongate slits in the selected portions of the outer surface of the front wall 26 prior to applying the adhesive material 24 to the back flap extension member 22. The step of forming a plurality of auxiliary apertures 38 comprise a plurality of elongate slits preferably spaced apart across a width of the front wall 26.

In all embodiments of the present invention, the step of forming a tube body includes forming the tube body comprising a plurality of layers selected from at least one of the following: a paper material, a metal foil material, and a plastic material. It is also preferable for the step of forming a tube body to include forming a tube body with a material capable of being tom so that an outer layer of the front wall 26 tears due to the material being weaker than the first bond region.

Other variations for the step of forming the tube body further includes forming the tube body with a plurality of layers can be made. For example, at least one of the plurality of layers can have a peripheral end portion that extends past other peripheral end portions of other layers. The back flap extension member 22 is preferably connected to the at least one of the plurality of layers having a peripheral end portion that extends past the other peripheral end portions of the other layers and is formed of the same material as the at least one of the plurality of layers. The at least one of the plurality of layers preferably includes an innermost layer of the plurality of layers. As another variation, the back flap extension member 22 can have a longer longitudinal extent than the front minor extension member 27.

The anti-tampering feature of the present invention can be advantageously applied to one or both ends of the bag. If only applied to one end, the other end can be closed with another type of closure. The bag 20 of the present invention can be formed with other types of closures attached to one end of the tube bag. For example, the method of forming the bag 20 of the present invention can further include the step of forming a pinch bottom on the second end 23 of the bag 20 and attaching a reclosable sealer on the first end 21 of the bag. Other types of closures can be used instead of a reclosable sealer and will be known to those skilled in the art.

While forming the bag 20 of the present invention, the step of applying the adhesive material 24 can include positioning the adhesive material 24 on the back flap extension member 22 with a preselected spray pattern, as shown in FIG. 10. If the adhesive material is applied to both sides of the bag, the adhesive material is applied to the front flap extension member 30, as illustrated in FIG. 9. The preselected spray pattern can be selected from at least one of the following: spiral spray, flood coat, swirl spray, atomized spray, and slot coating. Other spray patterns can be used, will be known to those skilled in the art, and are to be considered within the scope of the present invention.

The method of forming the bag 20 of the present invention can include the step of positioning a pre-applied primer material 32 positioned on an outer surface of selected first end portions of the back wall 28 and a pre-applied adhesive material 40 positioned to overlie the back flap extension member 22. The pre-applied primer material 32 is applied so that pre-applied primer material contacts substantially all of the outer surface of the selected first end portions of the back wall 28. The pre-applied primer 32 fills in the pores in the substrate forming the back wall 28 to provide more surface area for contacting with the pre-applied adhesive material 40. These pre-applied materials will allow users to melt the pre-applied primer material 32 and pre-applied adhesive material 40 once the bag 20 has been filled with product and the back flap extension member 22 folded over to enable users to securely seal the first end 21 of the tube body, as shown in FIGS. 13 and 14. To prevent dust particles from products from contaminating the pre-applied materials, users can blow the dust off of the pre-applied materials. A typical method of reactivating the pre-applied materials includes exposing the pre-applied materials to a hot blower to melt the materials, folding the back flap extension member 22 over, and then pressing the back flap extension member 22 and selected first end portions of the back wall 28 together with a press. Other methods of reactivating the pre-applied materials will be known to those skilled in the art and are to be considered within the scope of the present invention.

As another embodiment of the present invention, a method of forming a bag 20 having a tamper evident feature associated therewith and contents therein has advantageously been provided. In this embodiment, the tamper evident feature is provided on both ends of the bag 20. The method includes the step of applying a primer material to overlie selected portions of a substrate to form a first end and a second end primed portion of the substrate. The lower primer material 34 is applied to overlie selected lower portions of an outer surface of the front wall 26 to thereby define a lower first bond region between the selected lower portions of the outer surface of the front wall 26 and the lower primer material 34. The upper primer material 32 is also applied to overlie selected upper portions of an outer surface of the back wall 28 to thereby define an upper first bond region between the selected upper portions of the outer surface of the back wall 28 and the upper primer material 34. The lower and the upper primer material 32 are applied so that lower and upper primer material 34 contacts substantially all of the selected portions of the front wall 26 and the back wall 28 respectively. As illustrated in FIG. 3A, the primer material 34 fills in the pores in the substrate to provide more surface area for contacting with the an adhesive material 24. The first end primed portion defines a first end first bond region between the primer material and the first end selected portions of the substrate. The first end primed portion forms selected first end portions of an outer surface of the front wall. The second end primed portion of the substrate defines a second end first bond region between the selected portions of the substrate and the primer material. The second end primed portion forms selected second end portions of an outer surface of the back wall 28. A tube body is then formed having an open end and a closed end positioned substantially opposite the open end. The tube body has a front wall 26 positioned between the open end and the closed end and a back wall 28 positioned to face opposite the front wall 26. The tube body further includes a lower back flap extension member 22 connected to and extending outwardly from the second end 23 of the back wall 28 and an upper front flap extension member 30 connected to and extending outwardly from the first end 21 of the back wall 28. A lower adhesive material 24 is preferably applied to overlie the lower back flap extension member 22 to thereby define a lower second bond region between the lower primer material 32 and the lower adhesive material 24, once the lower back flap extension member 22 is folded over the selected lower portions of the outer surface of the front wall 26. An upper adhesive material 40 is preferably applied to overlie the upper front flap extension member 30 to thereby define an upper second bond region between the upper primer material 32 and the upper adhesive material 40. The lower back flap extension member 22 is preferably folded to overlie and adhere to the selected lower portions of the outer surface of the front wall 26 to thereby securely close the second end 23. The first lower bond region is preferably stronger than the second lower bond region so that when the lower back flap extension member 22 liftingly separates from the front wall 26, at least one of the selected portions of the second end of the front wall 26 and the second end back flap extension member 22 tears indicating tampering with the second end 23 of the bag 20 has occurred. The bag 20 can then be filled with an end user product. Once the bag 20 is filled, the upper back flap extension member 30 is preferably folded to overlie and adhere to the selected upper portions of the outer surface of the front wall 26 to thereby securely close the first end 21. The first upper bond region is preferably stronger than the second upper bond region so that when the upper back flap extension member 30 liftingly separates from the selected first end portions of the front wall 26, at least one of the selected first end portions of the front wall 26 tears indicating tampering with the first end 21 of the bag 20 has occurred.

As another embodiment of the present invention, a method of indicating tampering of a bag 20 is also provided. The method preferably includes the step of liftingly separating a flap extension member 22 from selected portions of a bag wall 26 having a bond enhancer positioned between the flap extension member 22 and the selected portions of the bag wall 26. As a result of liftingly separating the flap extension member 22 from the selected portions of the bag wall 26, at least one of the flap extension member 22 and the selected portions of the bag wall 26 tears resulting in an indication that tampering with the bag 20 has occurred. FIG. 12 illustrates selected second end portions of the front wall being torn due to the separation of the layers. The bond enhancer preferably includes an adhesive material 24 and a primer material 34. The adhesive material 24 preferably includes a first polyolefin polymer and the primer material 34 preferably includes a second polyolefin polymer. The second polyolefin polymer preferably has a different chemical polyolefin composition from the first polyolefin polymer. The first polyolefin polymer preferably comprises a modified polyolefin polymer. The second polyolefin polymer preferably includes a vinyl acetate polymer.

Figure 20:
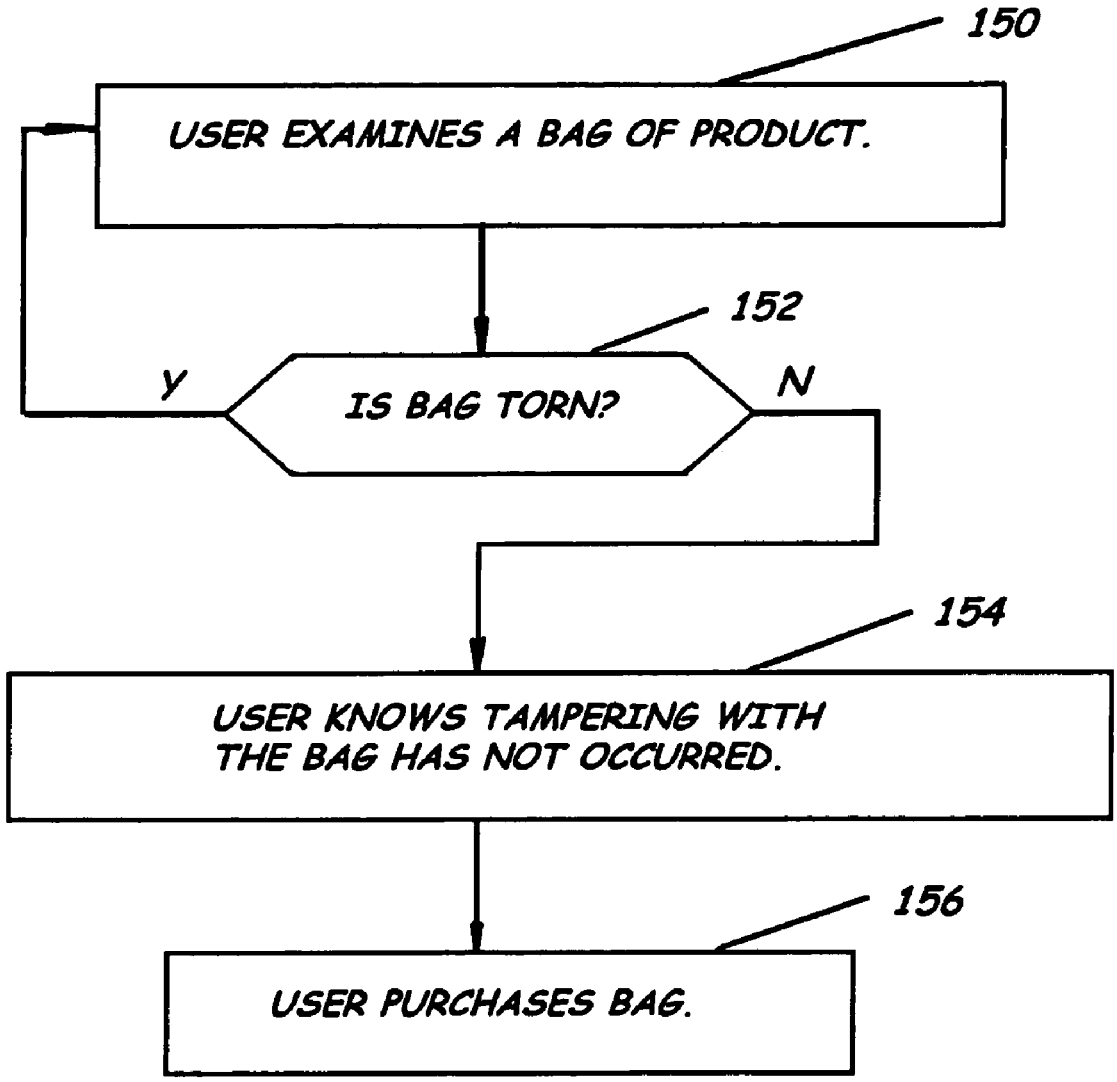
FIG. 20 is a flow diagram of a method of deciding whether or not to purchase a tamper evident bag made in accordance with one embodiment of the present invention.

The method of indicating tampering with the bag 20 allows customers to decide if they should purchase products contained with such a bag, as described in FIG. 20. A user can examiner the bag of product (block 150) and ascertain if the bag is tom (block 152). If the bag is not torn, the user knows that tampering with the bag has not occurred (block 154). The user can purchase or use the bag (block 156) with a level of confidence that tampering with the bag 20 has not occurred.

It is envisioned that the tamper evident packaging of the present invention can be used for any type of product that requires easy access to the contents within. It is envisioned that the tamper evident feature of the present invention can be used on both ends of the package, once the package has been filled with product. Such product uses include bags for various food items, pet food, charcoal, building materials, seed, lawn and garden supplies, and other uses as will be known to one skilled in the art and are to be considered within the scope of this invention.

As an advantage of the present invention, the tamper evident feature will enable users to readily discover if tampering with the bag 20 has occurred. The obvious sign of a torn bag 20 will alert users that someone has previously opened or attempted to open the bag.

As another advantage of the present invention, the materials needed to form the tamper evident feature of the present invention are readily available and can be applied using existing processes and equipment. There is no need to purchase additional machinery to use the tamper evident feature of the present invention.

From the foregoing it will be seen that the invention is well adapted to attain all of the ends and objects hereinabove set forth, together with other advantages that are obvious and that are inherent to the method and product. It will be understood that certain features and sub-combinations are of utility and may be employed without reference to other features and sub-combinations. This is contemplated by and is within the scope of the claims.

Because many possible embodiments may be made of the invention without departing from the scope thereof, it is to be understood that all matter herein set forth or shown in the accompanying specification is to be interpreted as illustrative and not in a limiting sense. It should be apparent to those skilled in the art that the invention is susceptible to various changes without departing from the scope of the invention.

For example, various types of substrates with or without coatings can be used to form the tube body of the bag. Suitable substrates and coatings will be known to one skilled in the art. The use of the bag 20 with the tamper evident feature can be used for many types of user end products, such as candy, food items, or any type of packaging that needs a strong bag with easy access to the contents of the bags.

The invention claimed is:

1. A method of forming a bag having a tamper evident feature associated therewith, the method comprising:

applying a primer material to overlie selected portions of a substrate to form a primed portion of the substrate and to thereby define a first band region between the selected portions of the substrate and the primer material;

forming a tube body with at least the substrate, the tube body having a first end and a second end positioned substantially opposite the first end, the tube body having a front wall positioned between the first end and the second end and a back wall positioned to face opposite the front wall, the primed portion of the substrate selected second end portions of an outer surface of the front wall, the tube body further including a back flap extension member connected to and extending outwardly from the second end of the back wall and a front flap extension member connected to and extending outwardly from the second end of the front wall;

applying an adhesive material to overlie the back flap extension member; and folding the back flap extension member to overlie and adhere to the front flap extension member and the selected second end portions of the outer surface of the front wall to thereby securely close the second end, the primer material and the adhesive material thereby defining a second bond region, the first bond region being stronger than the second bond region so that when the back flap extension member liftingly separates from at least one of the front wall and the front flap extension member, at least one of the back flap extension member and the selected portions of the outer surface of the front wall tears indicating tampering with the second end of the bag has occurred.

2. A method as defined in claim 1, further comprising the step of drying the primer material prior to forming the tube body.

3. A method as defined in claim 1, wherein the step of applying the primer material included printing material on the selected portions of the outer surface of the front wall so that the primer material is applied to substantially all of the selected portions of the outer surface of the front wall.

4. A method as defined in claim 1, wherein the steps of applying the adhesive material and applying the primer material includes applying the adhesive material comprising a first polyolefin polymer and the primer material comprising a second polyolefin polymer, wherein the second polyolefin polymer has a different chemical polyolefin composition from the first polyolefin polymer.

5. A method as defined in claim 4, wherein the step of applying the adhesive material and applying the primer material includes applying the first polyolefin polymer comprising a modified polyolefin polymer and applying the second polyolefin polymer comprising a vinyl acetate polymer.

6. A method as defined in claim 1, wherein the step of forming a tube body includes forming a plurality of auxiliary apertures in the selected portions of the outer surface of the front wall prior to applying the adhesive material.

7. A method as defined in claim 6, wherein the step of forming a plurality of auxiliary apertures includes spacing the plurality of auxiliary apertures apart across a width of the front wall, the plurality of auxiliary apertures comprising a plurality of elongate slits.

8. A method as defined in claim 1, wherein the step of forming a tube body includes forming the tube body comprising a plurality of layers selected from at least one of the following: a paper material, a metal foil material, and a plastic material.

9. A method as defined in claim 8, wherein the step of forming a tube body includes forming a tube body with a material capable of being torn so that an outer layer of the front wall tears due to the material being weaker than the first bond region.

10. A method as defined in claim 1, wherein the step of forming the tube body further includes forming the tube body with a plurality of layers wherein at least one of the plurality of layers having a peripheral end portion extends past other peripheral end portions of other layers, wherein the back flap extension member is connected to at least one of the plurality of layers having a peripheral end portion that extends past the other peripheral end portions of the other layers, and is formed of the same material as at least one of the plurality of layers.

11. A method as defined in claim 10, wherein at least one of the plurality of layers comprises an innermost layer of the plurality of layers and the step of forming a tube body includes forming the tube body with the back flap extension member having a longer longitudinal extent than the front flap extension member.

12. A method as defined in claim 1, wherein the step of applying the adhesive material includes positioning the adhesive material on the back flap extension member with a preselected spray pattern selected from at least one of the following: spiral spray, flood coat, swirl spray, atomized spray, and slot coating.

13. A method as defined in claim 1, further including the step of positioning a pre-applied primer material positioned on an outer surface of selected first end portions of the back wall and a pre-applied adhesive material positioned on to overlie a first end front flap extension member, the first end front flap extension member being adapted to fold over, overlie, and adhere to the outer surface of selected first end portions of the back wall, thereby allowing users to melt the pre-applied primer material and pre-applied adhesive material once the bag has been filled and the first end front flap extension member has been folded over the outer surface of selected first end portions of the back wall to enable users to securely seal the first end of the tube body.

14. A method of forming a bag having a tamper evident feature associated therewith and contents therein, the method comprising:

applying a primer material to overlie selected portions of a substrate to form a first end primed portion of the substrate and to thereby define a first end first bond region and to form a second end primed portion of the substrate and to thereby define a second end first bond region between the selected portions of the substrate and the primer material;

forming a tube body with at least the substrate, the tube body having a first end and a second end positioned substantially opposite the first end, the tube body having a front wall positioned between the first end and the second end and a back wall positioned to face opposite the front wall, the first end primed portion of the substrate forming selected first end portions of an outer surface of the front wall, the second end primed portion of the substrate forming selected second end portions of an outer surface of the back wall, the tube body further including a first end back flap extension member connected to and extending outwardly from the first end of the back wall and a second end front flap extension member connected to and extending outwardly from the second end of the front wall;

applying an adhesive material to overlie the first end back flap extension member and the second end front flap extension member; and folding the second end front flap extension member to overlie and adhere to the selected second end portions of the outer surface of the back wall to thereby securely close the second end, the primer material and the adhesive material thereby defining a first end second bond region and a second end second bond region, the second end first bond region being stronger than the second end second bond region so that when the second end front flap extension member liftingly separates from the front wall, at least one of the second end portion of the outer surface of the back wall and the second end front flap extension member tears to thereby define a second tear region and so that the second tear region indicates that tampering with the second end of the bag has occurred; filling the bag with an end user product; and folding the first end back flap extension member to overlie and adhere to the selected first end portions of the outer surface of the front wall to thereby securely close the first end, the first end first bond region being stronger than the first end second bond region so that when the first end back flap extension member liftingly separates from the selected first end portions of the outer surface of the front wall, at least one of the first end back flap extension member and the selected first end portion of the outer surface of the front wall tears to thereby define a first tear region and so that the first tear region indicates that tampering with the first end of the bag has occurred.

15. A method as defined in claim 14, wherein the step of forming a tube body includes forming the tube body comprising a plurality of layers selected from at least one of the following: a paper material, a metal foil material, and a plastic material.

16. A method as defined in claim 14, further including the step of drying the primer material prior to forming the tube body.

* * * * *

UNITED STATES PATENT AND TRADEMARK OFFICE

CERTIFICATE OF CORRECTION

PATENT NO. : 7,322,921 B2
APPLICATION NO. : 11/201871
DATED : January 29, 2008
INVENTOR(S) : John R. Allen et al.

It is certified that error appears in the above-identified patent and that said Letters Patent is hereby corrected as shown below:

Column 14, Line 15 reads, ". . . of being tom so that an outer . . ." which should read --. . . of being torn so that an outer . . .--

Column 16, Line 49 reads, ". . . the bag is tom (block 152)." which should read --. . . the bag is torn (block 152).--

Signed and Sealed this

Twelfth Day of August, 2008

JON W. DUDAS
*Director of the United States Patent and Trademark Office*